US010538888B2

(12) United States Patent
Tesler et al.

(10) Patent No.: US 10,538,888 B2
(45) Date of Patent: Jan. 21, 2020

(54) WATER SOLUBLE COLLECTION BAG AND METHOD OF USE

(71) Applicants: Daniel Tesler, Beverly, MA (US); Jacob Paarlberg, Beverly, MA (US)

(72) Inventors: Daniel Tesler, Beverly, MA (US); Jacob Paarlberg, Beverly, MA (US)

( * ) Notice: Subject to any disclaimer, the term of this patent is extended or adjusted under 35 U.S.C. 154(b) by 0 days.

(21) Appl. No.: 15/687,671

(22) Filed: Aug. 28, 2017

(65) Prior Publication Data

US 2018/0058023 A1 Mar. 1, 2018

Related U.S. Application Data

(60) Provisional application No. 62/509,228, filed on May 22, 2017, provisional application No. 62/381,145, filed on Aug. 30, 2016.

(51) Int. Cl.
*E01H 1/12* (2006.01)

(52) U.S. Cl.
CPC ..... *E01H 1/1206* (2013.01); *E01H 2001/122* (2013.01)

(58) Field of Classification Search
CPC ..... E01H 1/1206; E01H 2001/122; B65D 75/5805; B65D 75/5811; B65D 75/5833; B65D 75/5816; B65D 75/5827; B65D 75/5822; B65D 75/5877
USPC ..... 383/66, 207–209
See application file for complete search history.

(56) References Cited

U.S. PATENT DOCUMENTS

| | | | | |
|---|---|---|---|---|
| 4,838,429 | A * | 6/1989 | Fabisiewicz | B65D 75/5838 383/205 |
| 5,855,435 | A * | 1/1999 | Chiesa | B65D 75/5838 383/204 |
| 6,109,787 | A * | 8/2000 | Stary | B65D 83/0847 221/45 |
| 8,722,122 | B2 * | 5/2014 | Vogt | B65D 75/5838 220/258.3 |
| 2009/0148081 | A1 * | 6/2009 | Rogers | B65D 33/24 383/204 |
| 2010/0111453 | A1 * | 5/2010 | Dierl | B65B 9/213 383/204 |
| 2010/0278454 | A1 * | 11/2010 | Huffer | B65D 75/5838 383/5 |
| 2011/0038569 | A1 * | 2/2011 | Huffer | B65D 33/20 383/207 |
| 2012/0187125 | A1 * | 7/2012 | Plourde | B65D 31/10 220/266 |
| 2015/0080904 | A1 * | 3/2015 | Kovarik | A01K 15/003 606/113 |
| 2016/0090214 | A1 * | 3/2016 | Kinigakis | B65D 33/20 383/211 |

FOREIGN PATENT DOCUMENTS

| | | | |
|---|---|---|---|
| CN | 101397081 | A * | 9/2007 |
| JP | 2013249179 | A * | 12/2013 |

* cited by examiner

*Primary Examiner* — Stephen A Vu
(74) *Attorney, Agent, or Firm* — Law Offices of Daniel A. Tesler, LLC

(57) ABSTRACT

The present invention is a water soluble collection bag for the disposal of bodily waste and pet fecal matter in a toilet. The present invention includes a method of use that prevents plumbing system clogs when disposing of bodily fluids and pet fecal matter in a toilet.

6 Claims, 16 Drawing Sheets

WATER SOLUBLE COLLECTION BAG AND METHOD OF USE

CROSS REFERENCE TO RELATED APPLICATIONS

This application claims the benefit of U.S. Provisional Patent Application No. 62/381,145 filed Aug. 30, 2016 and U.S. Provisional Patent Application No. 62/509,228 filed May 22, 2017, which are hereby incorporated by reference in their entirety.

FIELD OF THE INVENTION

The present invention relates to collection bags for human bodily waste and pet fecal matter, in particular, to collection bags that are water soluble.

BACKGROUND OF THE INVENTION

Fecal matter collection bags (hereinafter "collection bags"), in general, are used for human bodily waste and pet fecal matter. Both types of waste pose significant health and environmental risks if not disposed of properly. Collection bags can be used to pick up pet waste during walks or when a pet defecates in an owner's yard. Collection bags, when used for human bodily waste, are generally used in a hospital or clinical setting and separate hazardous waste from the patient and the staff.

BRIEF SUMMARY OF THE INVENTION

The sewage system is best equipped to process and neutralize the bacteria and micro-organisms contained in human bodily waste and pet fecal matter (hereinafter "waste") and the present invention can facilitate its disposal in a conventional water closet or toilet (hereinafter "toilet"). The present invention uses an innovative bag material and bag design, that in some aspects, holds and contains waste for a period of time and allows it to be disposed of in a toilet. In contrast to conventional collection bags, the present invention, is capable of dissolving when submersed in water, allowing it to be disposed in a toilet. The inventive collection bags, in some embodiments, also include features that increase the rate of dispersion in water for the bag and waste.

In some aspects, the collection bags can improve the speed at which a waste bag can dissolve after entering a sewage system via a toilet and increase the rate of dispersion of waste contained in the bag. The selectively openable features in some embodiments allow air to escape the bag when placed in a toilet, allowing the turbulent flow in the sewage system to rapidly disperse the bag and waste. The features of the collection bags can reduce the occurrence of toilet or sewage line clogs that can occur if air is trapped in a waste bag or if the collection bag fails to disperse in the sewage system. When air is trapped within a collection bag, it can become buoyant, resulting in difficulty in flushing down the toilet and possibly becoming stuck within a household plumbing system downstream of the toilet or within a sewage system.

The selectively openable features of the inventive collection bags can also improve their performance in septic systems. The selectively openable features increase the bag and waste's ability to disperse into the sewage stream prior to entering a septic system leaching field. It is beneficial for the collection bag and waste to break down and disperse into small parts or fully dissolve prior entry into a septic system's leaching field to prevent clogs and obstructions within this expensive and sensitive system.

In some embodiments, the collection bags of the present invention are constructed of a water-soluble material with at least one area on the side of the bag that can be converted into an opening by a user. The area or areas that can be converted into an opening can be accomplished through a variety of methods, including but not limited to, adding an opening with a removable cover, a tear strip, one or more tear tabs, one or more areas defined by perforations or other suitable means for easily creating an opening. The openings on the sides of some embodiments of the collection bag allow air to escape and allow water to freely communicate with the waste to facilitate its breakdown in the sewage stream. In some embodiments, the collection bags may use a perforated strip to allow the creation of an opening at the top of the bag. Perforations, perforated strips and perforated lines, as used herein, refer to an area of the bag that is modified or constructed to tear more easily than the plain bag material. Areas can be made to tear more easily through the use of many methods, including but not limited to the use of closely spaced holes, closely spaced slits or indentations in the bag material. Communicate, as used herein, describes the ability of a fluid to flow and contact any object that within its range of communication. This term is used to describe the ability of water to flow through an opening in the collection bag to contact the fecal matter inside and the inside surface of the bag. The term also describes the ability of the fecal matter to dissolve in the water and freely communicate with the water outside of the bag, in other words, dissolve and flow out of the opening(s).

The present invention also provides methods of disposing waste in a household toilet using the collection bags of the present invention. One method is comprised of placing the waste or fecal matter into the collection bag, transporting the collection bag to a toilet, uncovering or causing an opening to be created in the collection bag, placing the collection bag into the toilet and flushing the toilet.

The embodiments presented in this application are optimized for the collection and disposal of pet fecal matter, however, it is appreciated that the invention is applicable to human bodily waste collection bags and other flushable bags within the inventive concept expressed herein.

DETAILED DESCRIPTION OF THE INVENTION

In some aspects, the present invention is a water soluble collection bag capable of being sealed and later opened to facilitate the disposal of human bodily waste and pet fecal matter in a toilet. The present invention further includes methods of using the collection bags to dispose of waste in a toilet. Only the preferred embodiments are shown herein and it is understood that variations in the construction of the present invention or method of use would be within the inventive concept expressed herein.

The collection bags of the present invention are preferably made of a thin water soluble material, or bag material, that can dissolve in water. Bag material, as used herein, refers to the primary material that the collection bags are constructed from. In some embodiments, the bag material is a substantially flat film that can be converted into the shape of the inventive collection bags. The bag material can be a film Polyvinyl alcohol (hereinafter "PVA") is a particularly appropriate material for the construction of the collection bags due to its ability to dissolve in water in a short period of time and the lack of environmentally harmful toxins when the material breaks down in water. PVA's solubility in water at various temperatures can be controlled by the degree of hydrolysis and molecular weight. In general, partially hydrolyzed PVA resins with a hydrolysis of 88% are capable of dissolving in water at room temperature. Partially hydrolyzed PVA resins with a hydrolysis of greater than 88% require increasingly warmer water to dissolve as the degree of hydrolysis increases. While PVA has been used in the preferred embodiments of the present invention, the collection bags can be produced in whole or in part of other materials. Other water soluble materials can be appropriate for the present invention, including but not limited to paper products and multi-layer materials. The collection bags can also be produced using a biodegradable material, including, but not limited to, hydroxyethylcellulose polymer, polyethylene glycol polymer, polycaprolactone, polylactic acid, hydroxybutyrate polymer, hydroxyvalerate polymer, a copolymer of hydroxybutyrate and hydroxyvalerate or a plant based material. The collection bags could also be produced using a non-biodegradable material where the openings would only facilitate the removal of material from a sealed collection bag.

Figure 1:
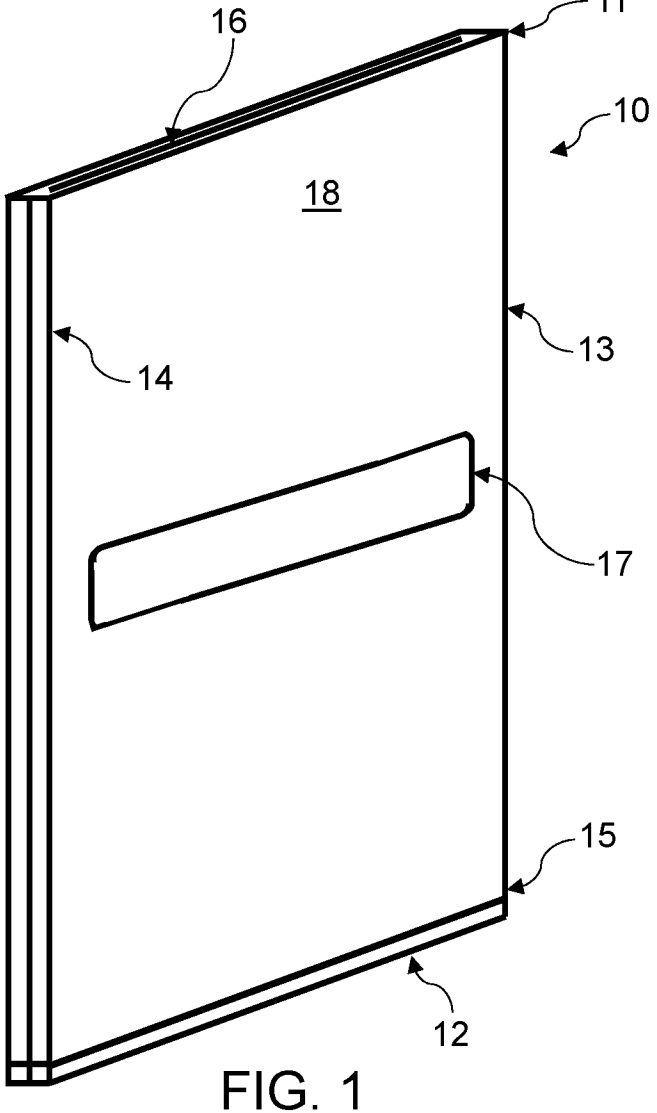
FIG. 1 is an perspective view of a first embodiment of the invention in a first position.

FIGS. 1-7 show a first embodiment of the invention from various angles and in multiple positions. In FIG. 1 is a perspective view of the first embodiment of the invention, a collection bag 10. In the perspective view, the front side 18 of the collection bag 10 is visible. The front side 18 has a sealed bottom 12, a sealed right side 13, a sealed left side 14 and an open top end 11. In some embodiments, the front side 18 and rear side 19 of the bag is comprised of a bag material with substantially the same thickness. In some examples, the front side 18 and read side are comprised of different bag materials and/or different thickness bag materials.

The figures show the bag material with an exaggerated thickness for clarity. From the perspective and side views, the collection bag material is shown to have a visible thickness, however, in actual practice, the collection bag material would not be nearly as thick as shown. When using PVA as the collection bag material, the thickness of the collection bag material is ideally between and including 10 to 500 microns. The collection bag material is preferably PVA with a thickness between and including 20 to 100 microns. The collection bag material is more preferably PVA with a thickness between and including 35 to 80 microns. In some embodiments, the collection bag material is PVA with a thickness between and including 35 to 45 microns. In other embodiments, the collection bag material is PVA with a thickness between and including 45 to 55 microns. In other embodiments, the collection bag material is PVA with a thickness between and including 55 to 80 microns.

The figures show the sides of the bag with a line delineating the front side and back side of the bags for clarity. In some embodiments, the line merely shows the crease between the front and rear sides of the collection bag rather than a location where there is necessarily a break in the material. In other embodiments, the line shows a break in excess material beyond a sealed edge towards the lateral sides of the collection bag. The collection bags can be constructed from multiple types of films, including but not limited to, blown and cast films. Blown films are generally manufactured in a tube shape so if constructed from a blown film, the line delineating the front side and back side of the bags would represent a crease in the material. Cast films are generally manufactured as in a flat shape so if constructed from a cast film, the line delineating the front side and back side of the bags would represent a break in the material beyond the sealed portion of the collection bag. A seal in the bag material is a location where multiple layers of bag material are fused together. Seals can be created in the bag material through the use of multiple methods, including the application of heat. For example, a heat sealer could be used to attach a front side panel to a back-side panel. Heat sealers generally leave some excess material on the side of the bag that would appear as two layers when viewed from the side.

At the top end is opening 16 that extends to the interior of the collection bag 10, creating a pocket for waste (hereinafter the "load") to be placed. To place a load in the collection bag 10, the front panel 18 and rear panel 19 can be pulled apart at the opening 16 to create an internal space or pocket that can accommodate the load. In the preferred embodiment, the sealed bottom 12 is formed through the application of a seal 15 near the bottom end of the collection bag 10. While a heat seal is used in the preferred embodiment, it is appreciated that there are a variety of other appropriate methods to close the bottom of the bag, including but not limited to applying an adhesive between the layers, using staples, using a stitch, etc. When using PVA as the collection bag material, the seal 15 at the bottom of the bag can be created by using water or moisture to partially dissolve and fuse the material together.

On the front side 18 of the collection bag 10 is a removable panel 17. The removable panel 17 is positioned to allow a user to seal the top end 11 of the bag and later access an opening on the side of the bag that is covered by the removable panel 17. While many variations of removable panels or tear strips can be used to accomplish this task, the first embodiment of the collection bag uses a removable panel 17 that is temporarily fixed to the front of the bag 18 to cover an opening 20 (not shown in FIG. 1) that passes through the front of the bag 18. The removable panel 17 can be fixed using a variety of methods that include, but are not limited to, an adhesive, melting portions of the removable panel 17 to the front side 18, mechanical fasteners, or a static cling.

Figure 2:
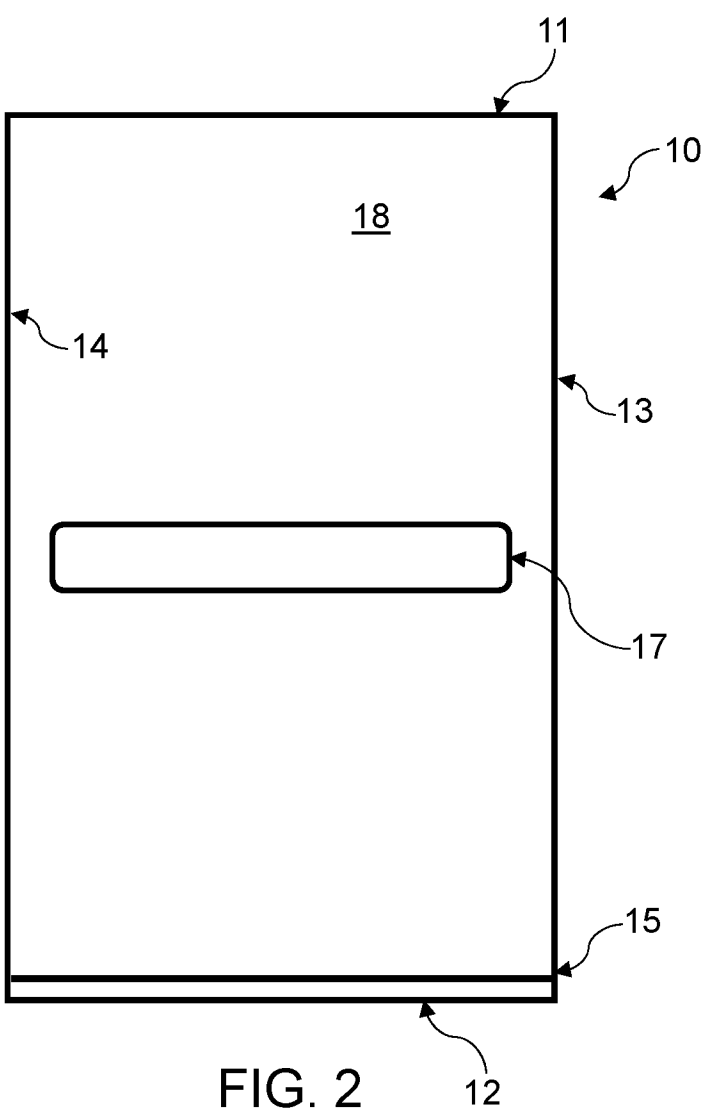
FIG. 2 is a front view of a first embodiment of the invention in a first position.

In FIG. 2 is a front view of the first embodiment of the collection bag 10 in a first position. The positions of the collection bag are defined by the position of removable strip 17 (or applicable method of creating an opening in later embodiments) in relation to the front side 18 of the collection bag 10. The first position is characterized by the removable strip 17 being flush against the front side 18 of the collection bag 10, substantially covering the opening 20. The second position is characterized by a portion of the removable strip 17 being pulled from the front side 18 of the collection bag 10, uncovering a portion of the opening 20, and a portion of the removable strip 17 being flush against the front side 18 of the collection bag, covering a portion of the opening 20. The third position is characterized by the removable strip 17 being completely removed, leaving the opening 20 uncovered, allowing free communication between the inside and outside of the collection bag 10 through the opening 20. Normally, a load would be placed in the collection bag 10 when in the first position. While not shown, a user may optionally tie or otherwise seal the top of the bag 11 to seal the load inside for transport. The top of the bag 11 may be sealed using multiple methods, including but not limited to, tying an overhand knot, a half knot or a square knot using the upper bag material. A user would then manipulate the removable strip 17 into the second position, then the third position prior to placing the collection bag 10 inside of a toilet bowl.

Figures 3, 4, 5:
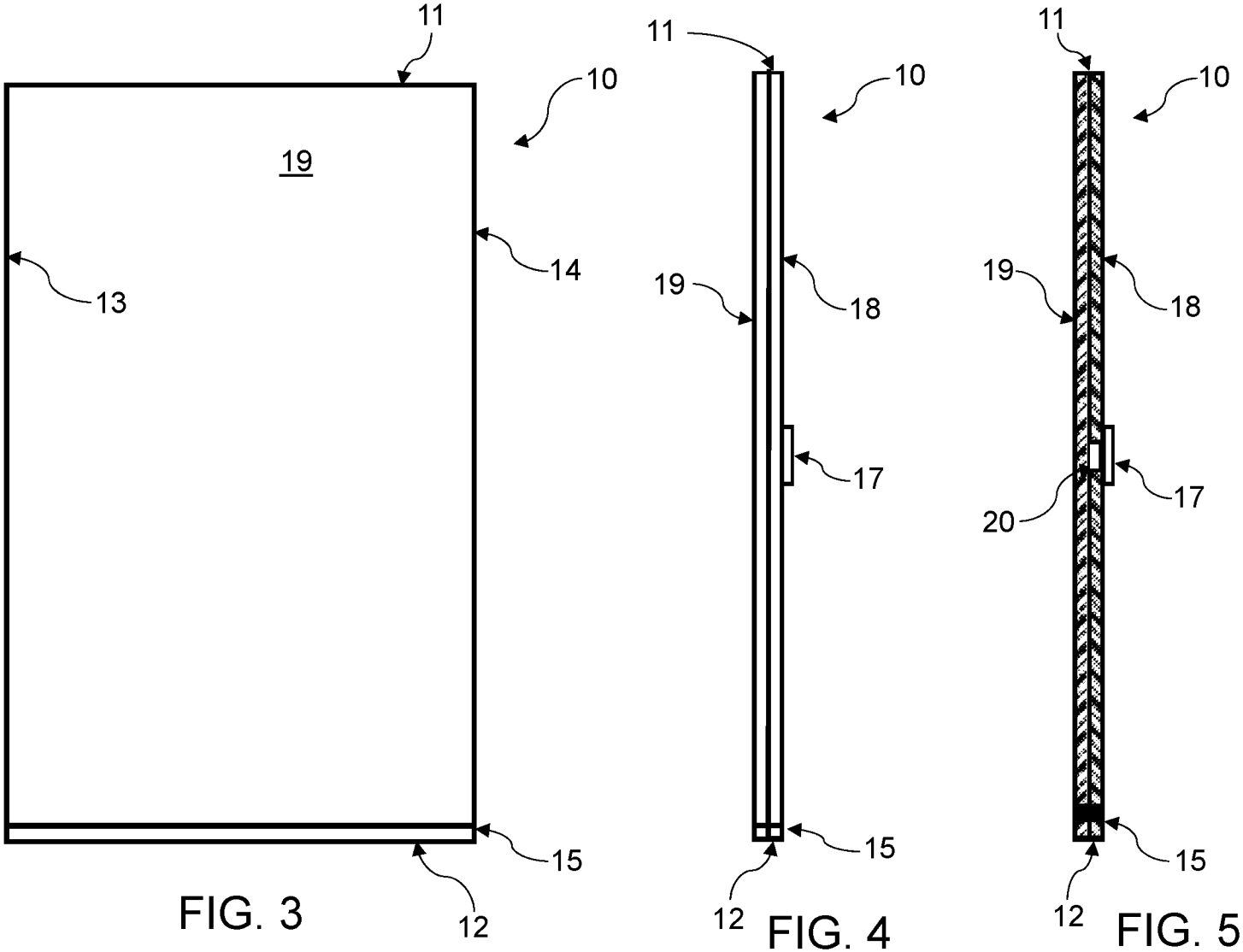
FIG. 3 is a rear view of a first embodiment of the invention in a first position.
FIG. 4 is a side view of a first embodiment of the invention in a first position.
FIG. 5 is a side sectioned view of a first embodiment of the invention in a first position.

In FIG. 3 is a rear view of the collection bag 10, showing the back side 19, the top 11, bottom, 12, right side 13 and left side 14 (right and left as viewed from the front view). The sealed area 15 is also visible in the rear view. In this embodiment of the collection bag 10, there are no openings on the back side 19 of the bag, however, they may be optionally added as shown in some of the subsequent embodiments.

In FIG. 4 is a side view of the first embodiment of the invention in a first position showing the layers of the collection bag 10. As noted previously, the layers of the collection bag are not shown to scale in the side and side sectioned views to provide additional clarity. If shown to scale, the layers of the collection bag would be difficult to see in the side and side sectioned views. Therefore, the side and side sectioned views shown within this application depict the layers of the various embodiments as thicker than to scale.

In FIG. 4, the front side 18 of the collection bag 10 is comprised of a layer of material and the rear side 19 of the collection bag 10 is comprised of a layer of material. At the bottom 12 of the bag, the bag is heat sealed together at area 15. The collection bag 10 is open at the top 11 and the removable panel 17 is mounted flush to the front side 18 of the collection bag 10.

In FIG. 5 is a side sectioned view of the first embodiment of the invention in a first position, showing the layers of the collection bag 10. The collection bag 10 is sectioned in FIG. 5 and all other side sectioned views, at the respective embodiment's vertical center in a direction normal to its front. In the side sectioned view, the opening 20 is visible between the removable strip 17 and the rear side 19 of the collection bag. When the removable strip 17 is removed, the area in the bag between the front side 18 and back side 19 can freely communicate through the opening 20 with the outside of the collection bag 10.

Figure 6:
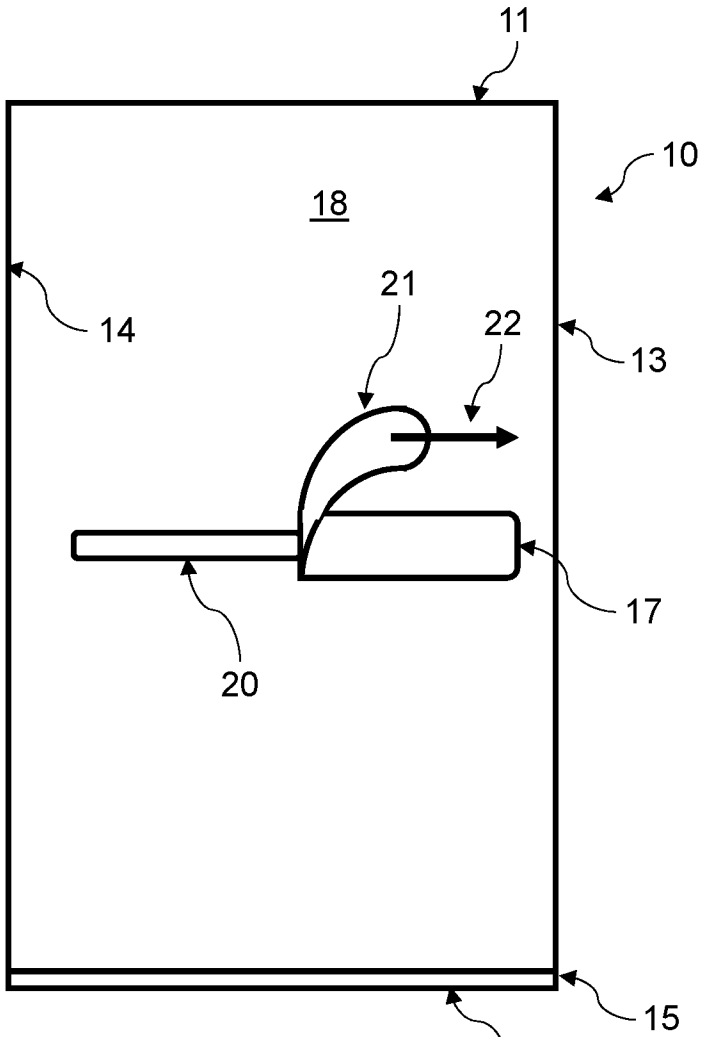
FIG. 6 is a front view of a first embodiment of the invention in a second position.

In FIG. 6 is a front view of the collection bag 10 in a second position. In this view, a portion 21 of the removable strip 17 has been pulled away from the front side 18 of the collection bag 10 in the general direction denoted by arrow 22. As the removable strip 17 is removed from the front side 18 of the collection bag 10, the opening 20 is uncovered.

Figure 7:
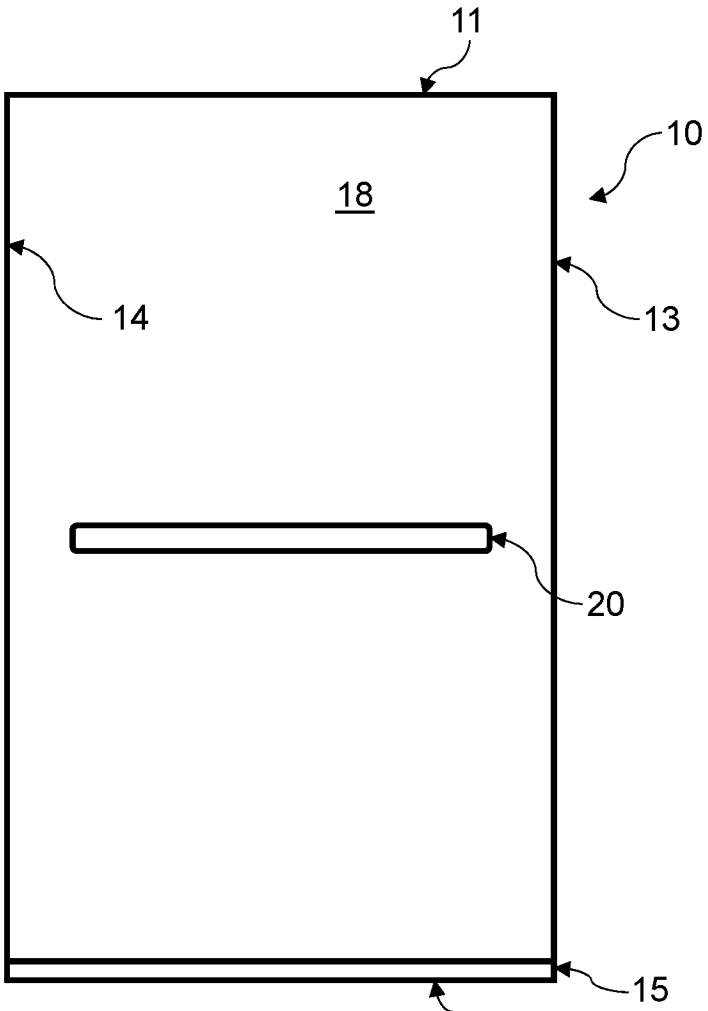
FIG. 7 is a front view of a first embodiment of the invention in a third position.

In FIG. 7 is a front view of the collection bag in a third position. In the third position, the removable strip 17 has been completely removed, uncovering opening 20. The collection bag 10 would be ready to place in a toilet when in the third position.

Figure 10:
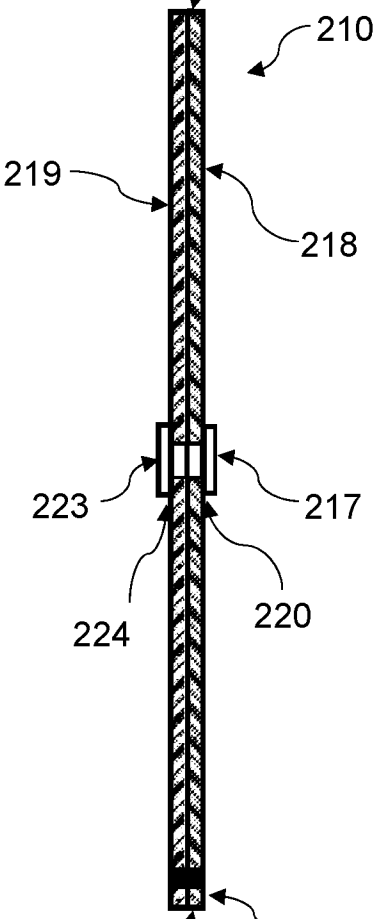
FIG. 10 is a side sectioned view of a second embodiment of the invention in a first position.
Figure 9:
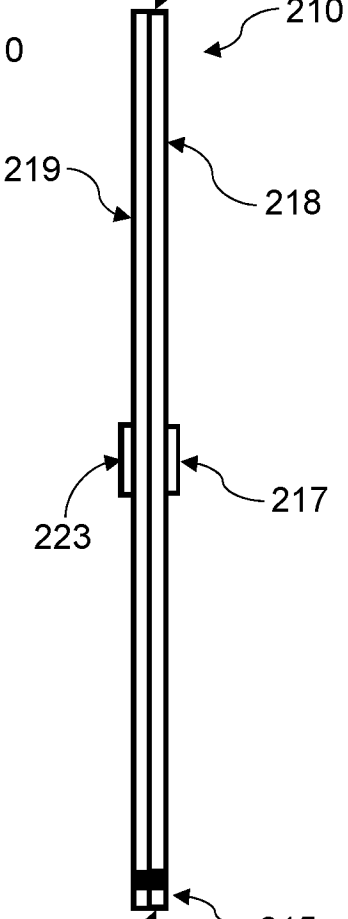
FIG. 9 is a side view of a second embodiment of the invention in a first position.
Figure 8:
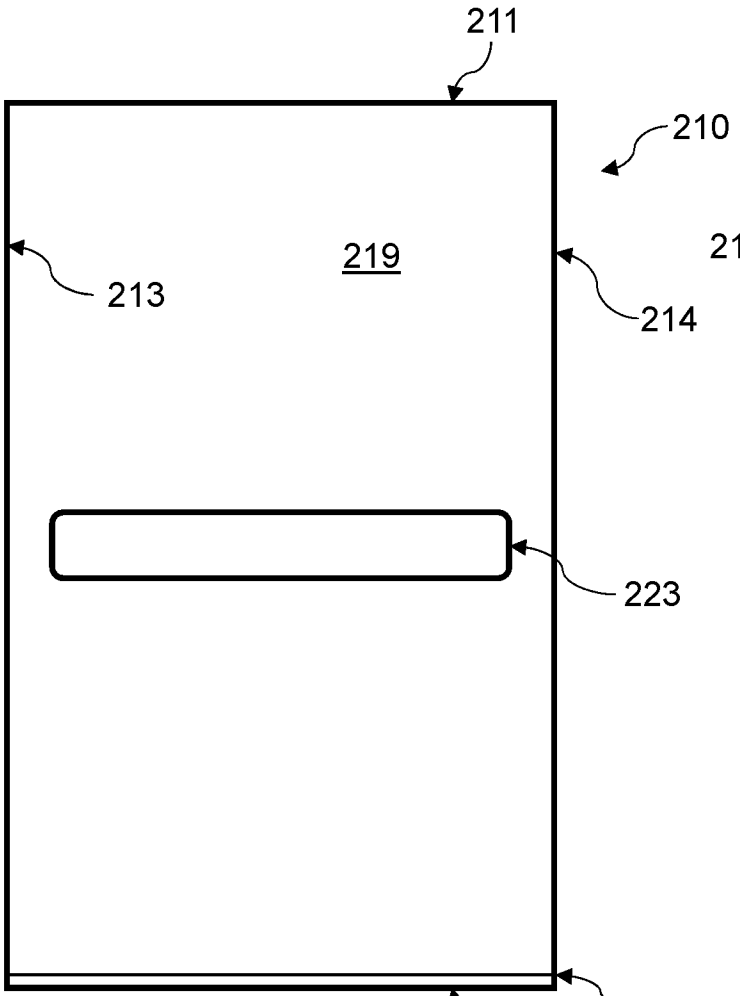
FIG. 8 is a rear view of a second embodiment of the invention in a first position.

In FIGS. 8-10 is a second embodiment of the collection bag 210 in a first position. The elements in the alternative embodiments which are substantially the same as the corresponding elements of the first embodiment described are identified with the same numeral. Elements which are similar (but not necessarily identical) in function are denoted by the same numeral plus 100.

The collection bag 210 in FIGS. 8-10 is substantially similar to the first embodiment on the front side 218, therefore only a rear, side and side sectioned view are shown. The collection bag 210 has a sealed right side 213 and left side 214 (right and left when viewed from the front). The bottom end 212 of the collection bag 210 is sealed. The collection bag 210 can use a heat seal 215 to seal the bottom end 212 of the collection bag 210, but it appreciated that there are other appropriate methods of sealing the bag as noted previously. The top end 211 of the collection bag 210 is open and provides the opening for a user to insert the load.

Instead of a plain back side, the collection bag 210 has a second removable strip 223 and a second opening 224 mounted on the back side 219 of the collection bag 210. The second removable strip 223 and second opening 224 on the back side 219 of the collection bag 210 can be substantially similar to the removable strip 217 and opening 220 on the front side of the bag 218. The height of the openings 220 & 224 relative to the bottom of the bag 212 can varied together or individually. The shape of the openings 220 & 224 may also be varied together or individually to change the characteristics of the bag when placed in a moving fluid. If the shape of openings 220 & 224 is changed, the shape and location of removable strip 217 and second removable strip 223 would need to be adjusted to adequately cover the openings 220 & 224.

Figure 13:
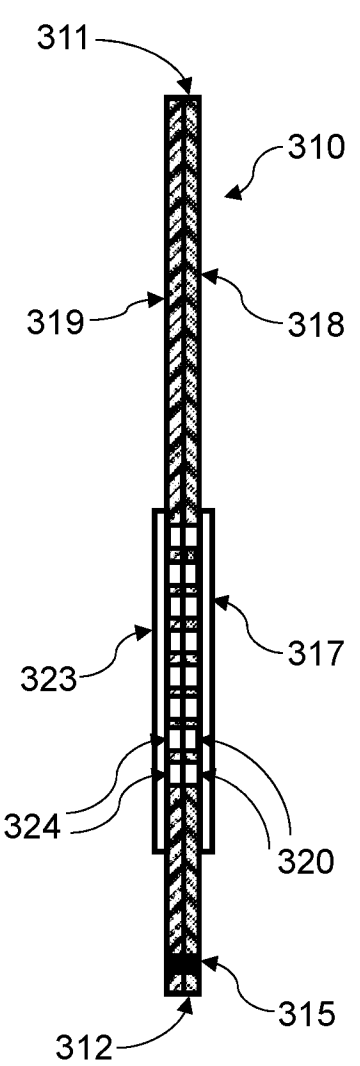
FIG. 13 is a side sectioned view of a third embodiment of the invention in a first position.
Figure 12:
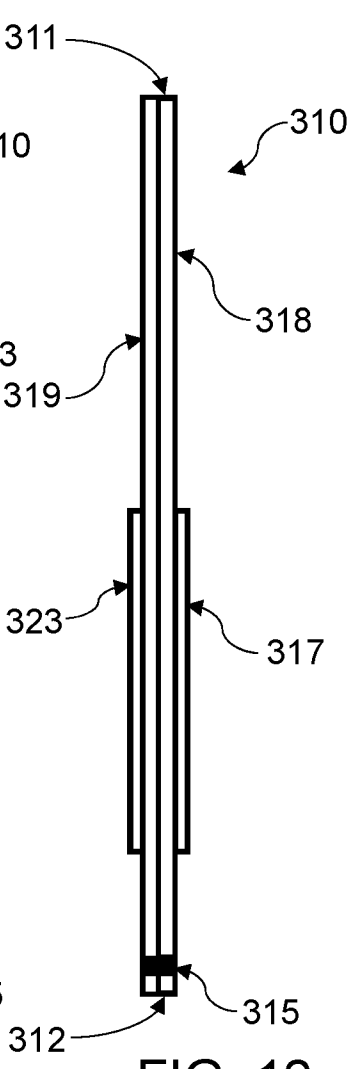
FIG. 12 is a side view of a third embodiment of the invention in a first position.
Figure 11:
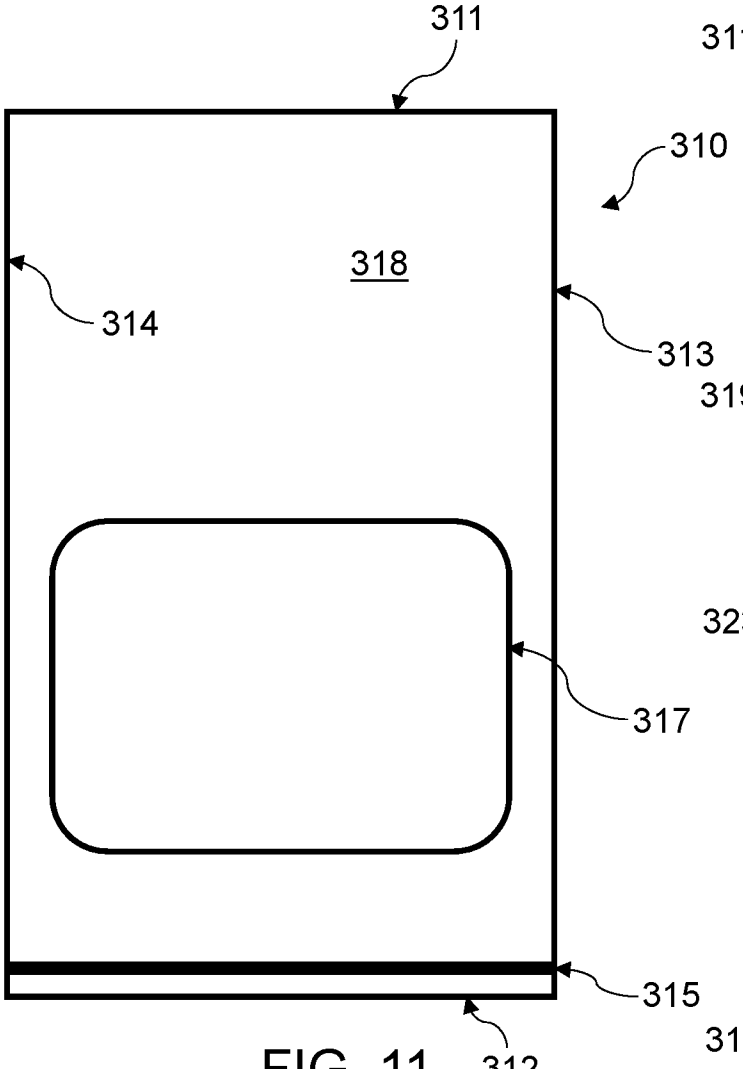
FIG. 11 is a front view of a third embodiment of the invention in a first position.

In FIGS. 11-13 is a third embodiment of the collection bag 310 in a first position. The front side 318 of the collection bag 310 in FIGS. 11-13 is substantially similar to its rear side 319, therefore only a front, side and side sectioned view are shown. The collection bag 310 has a sealed right side 313 and left side 314. The bottom end 312 of the collection bag 310 is sealed. The collection bag 310 can use a heat seal 315 to seal the bottom end 312 of the collection bag 310, but it appreciated that there are other appropriate methods of sealing the bag as noted previously. The top end 311 of the collection bag 310 is open and provides the opening for a user to insert the load.

The collection bag 310 has a removable strip 317 on the front side 318 and optionally has a substantially similar removable strip 323 on the back side 319. The removable strips 318 & 323 temporarily cover a plurality of holes 320 through the front side 318 of the collection bag and a plurality of optional holes 324 through the back side 319 of the collection bag, respectively. The height of the plurality of openings 320 & 324 relative to the bottom of the bag 312 can varied together or individually to place the openings above or adjacent to the load when placed in the collection bag 310. The shape of the openings 320 & 324 may also be varied together or individually to change the characteristics of the bag when placed in a moving fluid. If the overall area of the plurality of openings 320 & 324 is changed, the shape and location of removable strip 317 and second removable strip 323 would need to be adjusted to adequately cover the openings 320 & 324.

Figure 14:
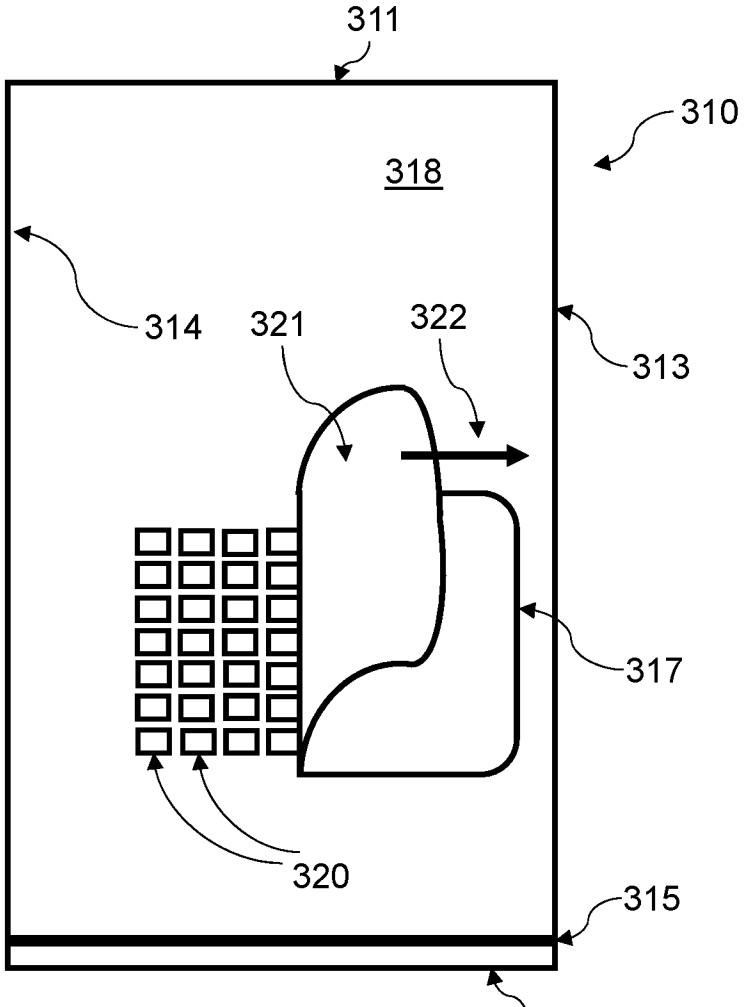
FIG. 14 is a front view of a third embodiment of the invention in a second position.

In FIG. 14 is a front view of the collection bag 310 in a second position. In this view, a portion 321 of the removable strip 317 has been pulled away from the front side 318 of the collection bag 310 in the general direction denoted by arrow 322. As the removable strip 317 is removed from the front side 318 of the collection bag 310, the openings 320 are uncovered. While only the front side 318 is shown in the second position, the rear side 319 would look substantially the same in the second position.

Figure 15:
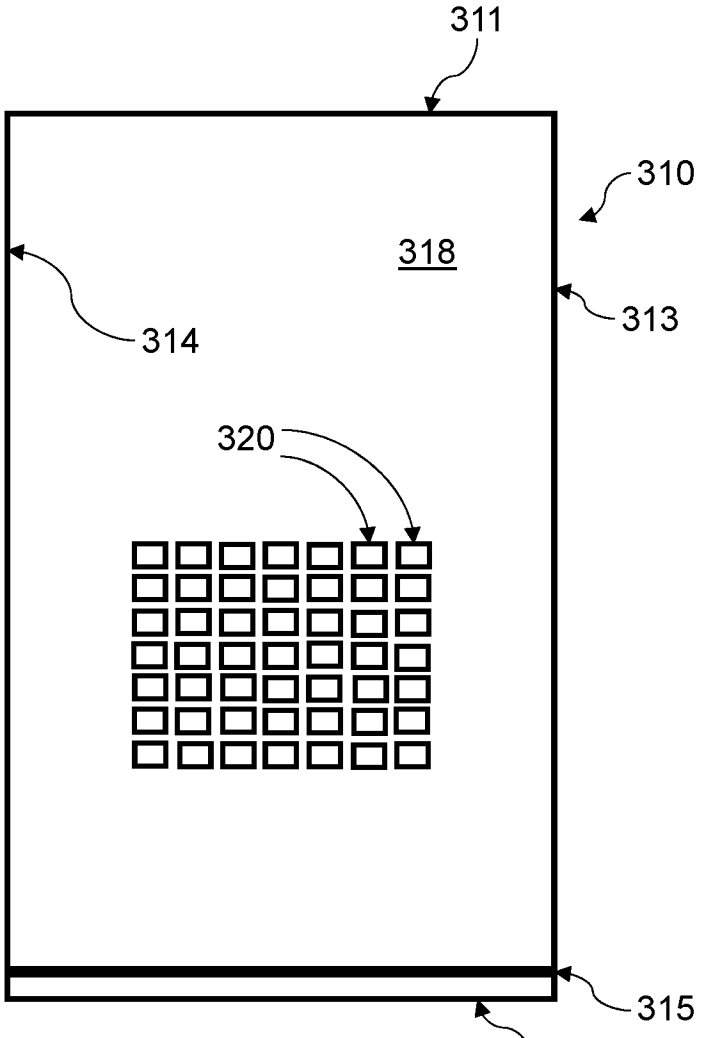
FIG. 15 is a front view of a third embodiment of the invention in a third position.

In FIG. 15 is a front view of the collection bag 310 in a third position. In the third position, the removable strip 317 has been completely removed, uncovering openings 320 completely. The collection bag 310 would be ready to place in a toilet when in the third position. While only the front side 318 is shown in the third position, the rear side 319 would look substantially the same in the third position.

The additional number and total area of the plurality of openings 320 & 324 in the third embodiment, when compared to the first and second embodiments allow water to more quickly and more thoroughly flow inside the collection bag 310 when placed in a toilet. The areas of the collection bag 310 situated between the individual openings 320 & 324 also serve as weak points in the bag and are likely to tear when flushed in a toilet, facilitating the load's escape from the collection bag 310 and likelihood of moving through the plumbing system independently of the collection bag 310.

Figure 18:
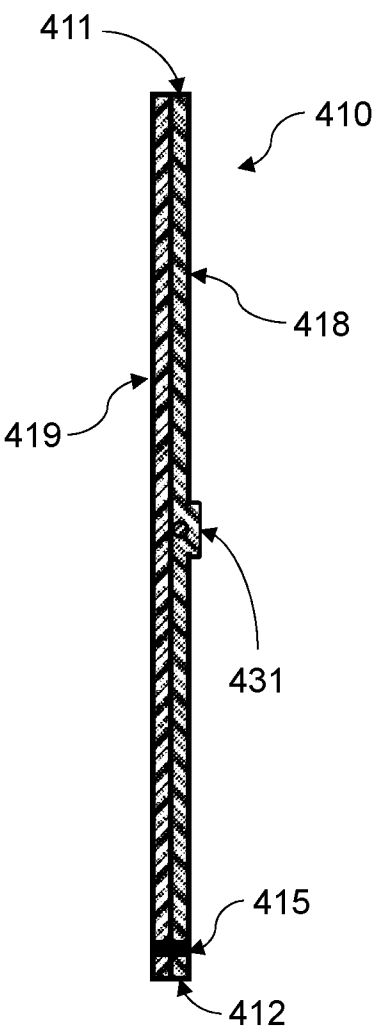
FIG. 18 is a side sectioned view of a fourth embodiment of the invention in a first position.
Figure 17:
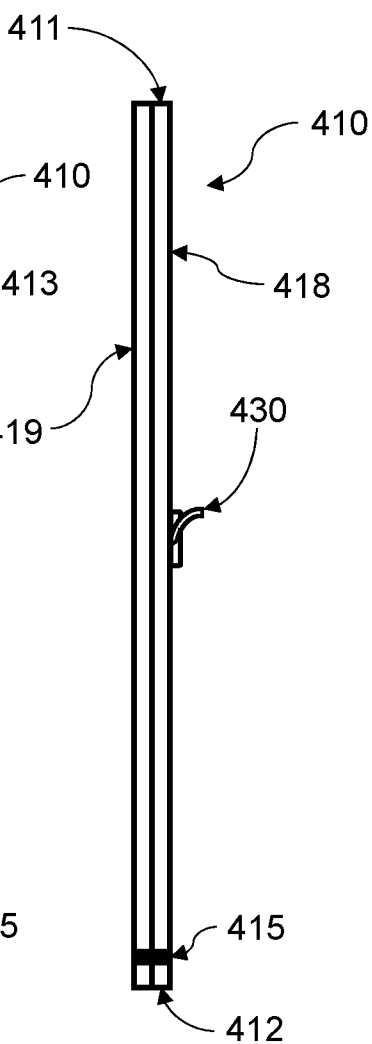
FIG. 17 is a side view of a fourth embodiment of the invention in a first position.
Figure 16:
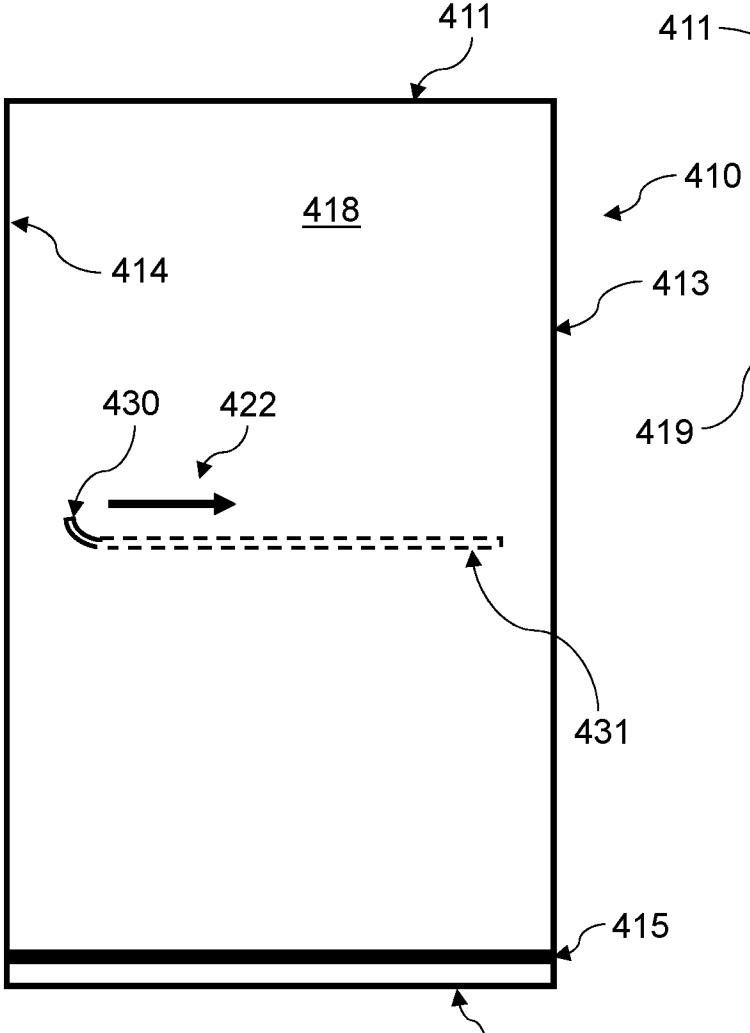
FIG. 16 is a front view of a fourth embodiment of the invention in a first position.

In FIGS. 16-18 is a fourth embodiment of the collection bag 410 in a first position. The rear side 419 of the collection bag 410 in FIGS. 16-18 is substantially the same as the rear side 19 of the first embodiment, therefore only a front, side and side sectioned view are shown. The rear side 419 of the collection bag 410 may optionally include a tear strip or means of creating an opening on that side. The collection bag 410 has a sealed right side 413 and left side 414. The bottom end 412 of the collection bag 410 is sealed. The collection bag 410 can use a heat seal 415 to seal the bottom end 412 of the collection bag 410, but it appreciated that there are other appropriate methods of sealing the bag as noted previously. The top end 411 of the collection bag 410 is open and provides the opening for a user to insert the load.

The collection bag 410 has a tear tag 430 and a hidden tear strip 431 to create an opening in the front side 418 of the bag. The tear tag 430 and hidden tear strip 431 may be constructed of a single continuous material or multiple materials. The tear tag 430 and tear strip 431 may be constructed of materials including string, plastic, metal, PVA or any other appropriate material that is flexible enough for a user to pull in the direction denoted by arrow 422 and strong enough to create an opening in the front side 418 of the collection bag 410. In FIG. 16, the hidden tear strip 431 is shown as a dotted line because it is mounted within or behind the front side 418 in this embodiment. The hidden tear strip 431 may alternatively be adhered to the front of the bag to accomplish the same ends.

The height of the hidden tear strip 431 relative to the bottom of the bag 412 can varied to place the resultant opening above or adjacent to the load when placed in the collection bag 410. The shape of the hidden tear strip 431 may also be varied to be longer, shorter, wider or not substantially straight to change the characteristics of the bag when placed in a moving fluid. If the shape and location of the hidden tear strip 431 is changed, the tear tag 430 would similarly need to be relocated to the new beginning of the hidden tear strip 431.

Figure 21:
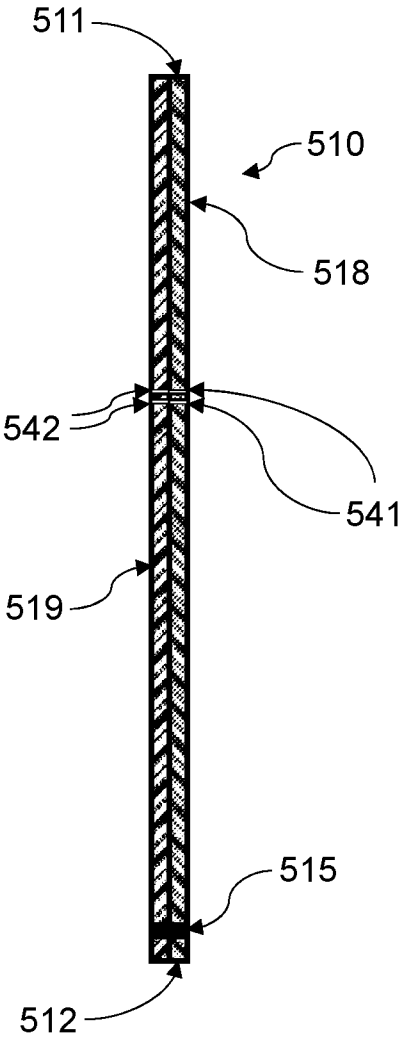
FIG. 21 is a side sectioned view of a fifth embodiment of the invention in a first position.
Figure 20:
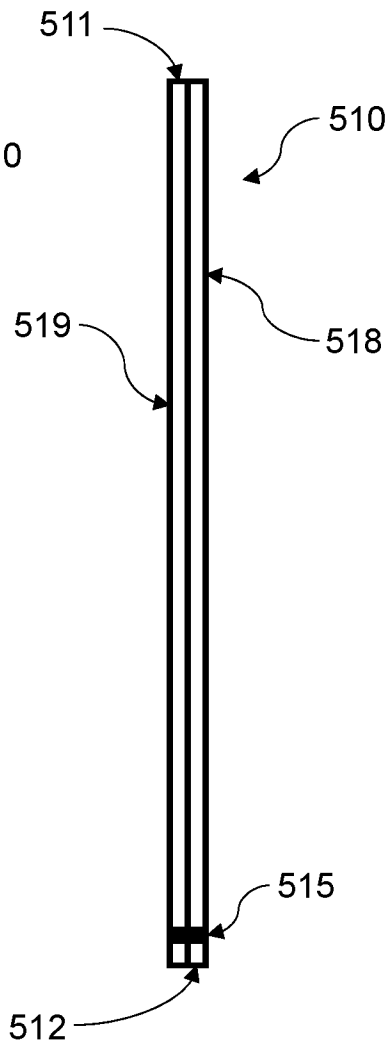
FIG. 20 is a side view of a fifth embodiment of the invention in a first position.
Figure 19:
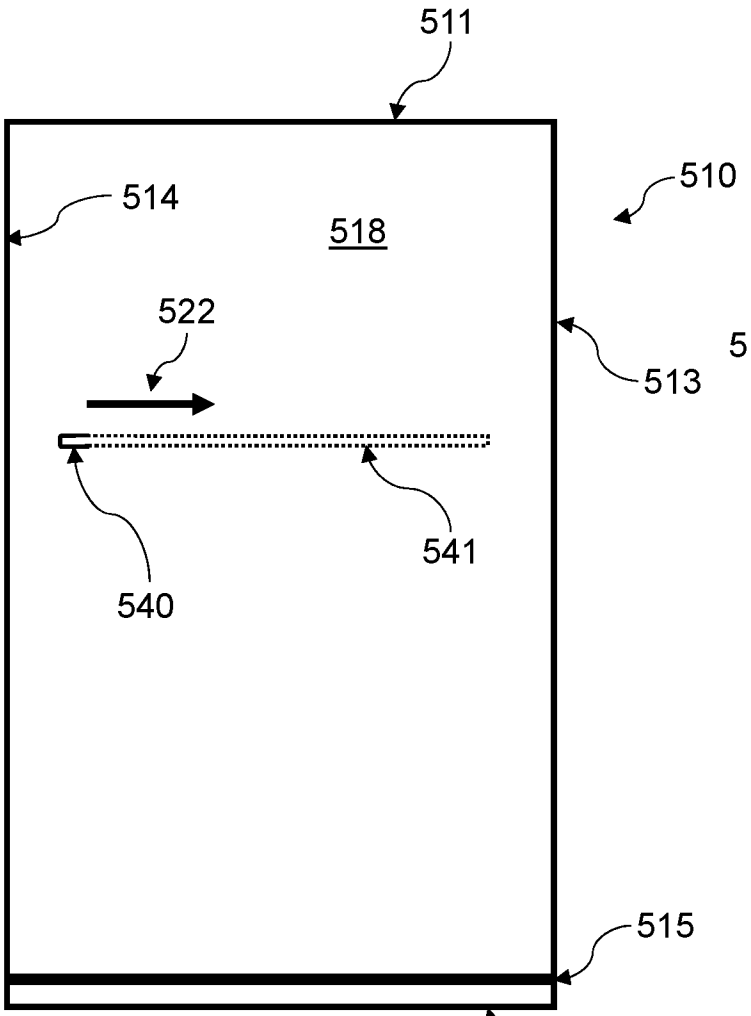
FIG. 19 is a front view of a fifth embodiment of the invention in a first position.

In FIGS. 19-21 is a fifth embodiment of the collection bag 510 in a first position. The rear side 519 of the collection bag 510 in FIGS. 19-21 is substantially similar to a mirror image of the front side 518, therefore only a front, side and side sectioned view are shown. The collection bag 510 has a sealed right side 513 and left side 514. The bottom end 512 of the collection bag 510 is sealed. The collection bag 510 can use a heat seal 515 to seal the bottom end 512 of the collection bag 510, but it appreciated that there are other appropriate methods of sealing the bag as noted previously. The top end 511 of the collection bag 510 is open and is provides the opening for a user to insert the load.

The collection bag 510 has a pull tab 540 and a series of holes 541 to allow a user to cleanly create an opening on the front side 518 and back side 519 of the bag. In this embodiment, the pull tab 540 is cut on three sides to define it. The pull tab 540 is cut on the sides closest to the left side 514, top side 511 and bottom side 512. The side of the pull tab 540 closest to the right side 513 is not cut and remains attached to an area of the front side 518 situated within the area bounded by a series of holes 541. While not shown in the figures, the rear side 519 has a substantially similar pull tab that is a mirror image of the front side 518.

The series of holes 541 on the front side 518 and the series of holes 542 on the back side 519 of the collection bag are substantially similar to a mirror image of one another. The holes 541 are close enough together and of a large enough diameter to allow a user pulling on pull tab 540 in the direction denoted by arrow 522 to cleanly tear an opening in the front side 518 of the collection bag that would be substantially the same shape as the outline created by the series of holes 541. The series of holes 542 on the back side 519 are situated similarly to the front to allow a user to tear a second opening in the back side 519 of the collection bag 510.

Because the series of holes 541 & 542 and the creation of pull tabs 540 create a through opening in the front side 518 and rear side 519 of the collection bag 510, it is preferable to place these features above the expected height of the load to prevent free communication between the load and the user's skin. The series of holes 541 & 542 are preferably small enough to prevent free communication through light or incidental contact between the load on the inside of the bag and the user on the outside of the bag, however, prolonged contact could allow some of the load to escape through the series of openings 541 & 542, making their placement above the height of the expected load a preferential feature.

The height of the series of holes 541 & 542 relative to the bottom of the bag 512 can be varied depending on the expected height of the load when placed in the collection bag 510. The shape of the area situated within the series of hole 541 & 542 may also be varied to be longer, shorter, wider or not substantially rectangular in shape to change the characteristics of the bag when placed in a moving fluid. If the shape and location of the series of holes 541 & 542 are changed, the tear tab 540 (and a similar tear tab on the back side 519) would similarly need to be relocated to an area at the perimeter of the series of holes 541 & 542.

In the collection bag 510, the front side 518 and back side 519 are substantially mirror images of each other to facilitate manufacturing using a pre-formed or blown tube of material. When using a pre-formed tube of material, the sides 513 & 514 of the collection bag would be connected prior to conversion or manufacturing, only necessitating the bottom end 512 of the bag to be sealed. The tube of material would need to be cut at the top end 511 and bottom end 512 to define the overall shape of the collection bag 510. The tear tabs 540 and series of holes 541 & 542 can be cut from a single direction (i.e. cut from the front side 518), resulting in a front side 518 and back side 519 that are mirror images of one another. If the collection bag 510 were to be constructed from two sheets of material that was then sealed on the sides 513 & 514 and bottom 512, the shape of the tear tabs 540 and series of holes 541 & 542 could differ on the front side 518 and back side 519.

Figure 24:
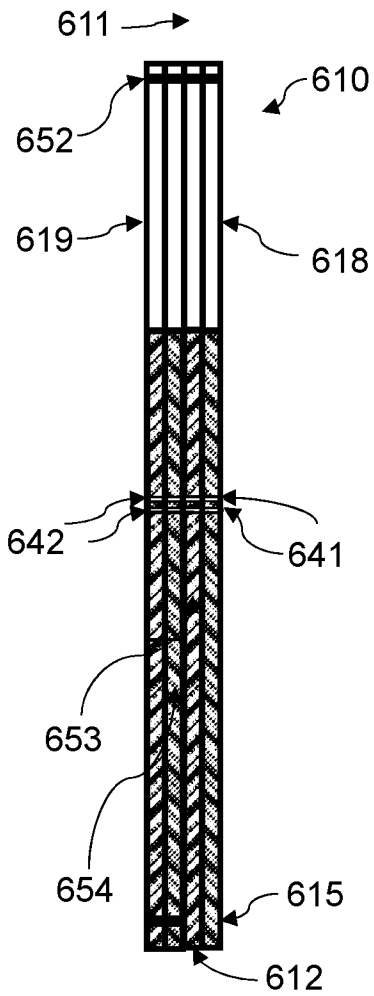
FIG. 24 is a side sectioned view of a sixth embodiment of the invention in a first position.
Figure 23:
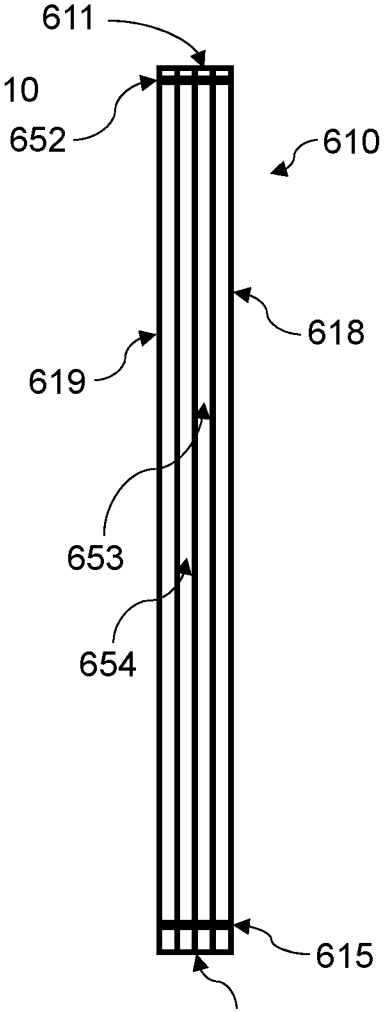
FIG. 23 is a side view of a sixth embodiment of the invention in a first position.
Figure 22:
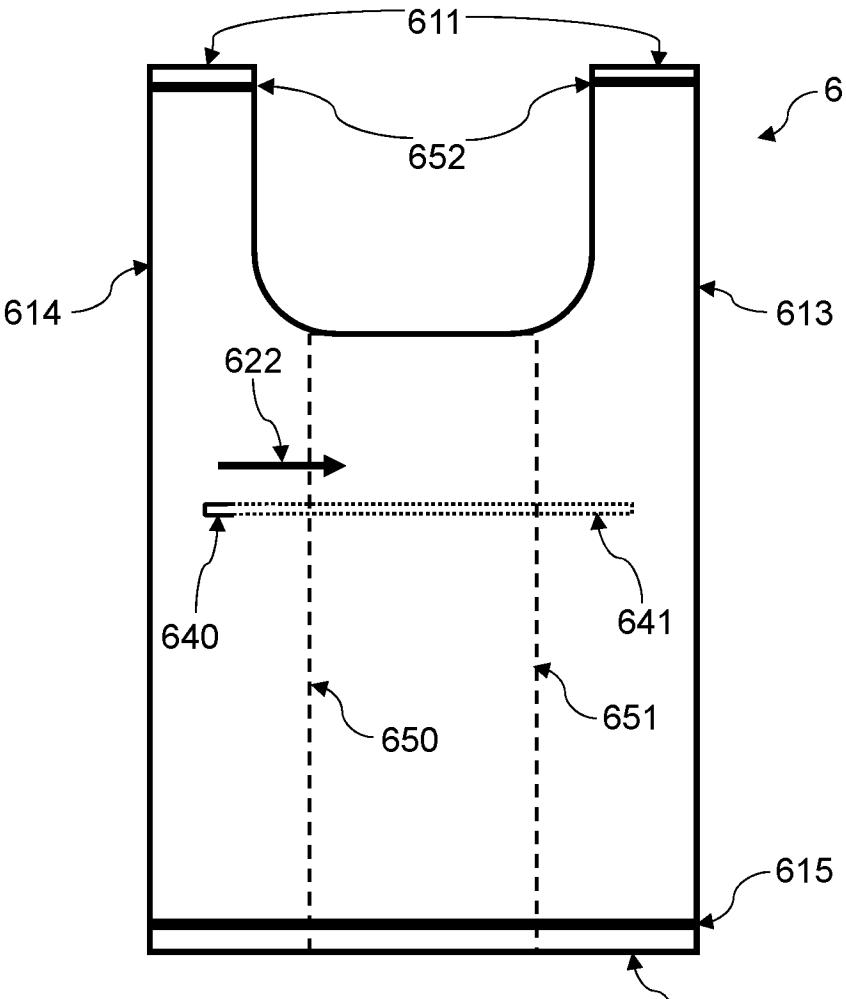
FIG. 22 is a front view of a sixth embodiment of the invention in a first position.

In FIGS. 22-24 is a sixth embodiment of the collection bag 610 in a first position. The rear side 619 of the collection bag 610 in FIGS. 22-24 is substantially similar to a mirror image of the front side 618, therefore only a front, side and side sectioned view are shown. The collection bag 610 has a sealed right side 613 and left side 614 with gusseted panels. The gusseted panels are hidden in the front view, but their width is marked with dashed lines 650 & 651. The gusseted panels have a front panel 653 and back panel 654 that fold between front side 618 and back side 619. The bottom end 612 of the collection bag 610 is sealed. The top end 611 of the collection bag 610 is also sealed in the handle areas 652 to form two handles when the collection bag is opened. The collection bag 610 can use a heat seal 615 and 652 to seal portions of the collection bag 610, but it appreciated that there are other appropriate methods of sealing the bag as noted previously. The top end 611 of the collection bag 610 is open between the sealed areas 652 and provides the opening for a user to insert the load.

The collection bag 610 has a pull tab 640 and a series of holes 641 to allow a user to cleanly create an opening on the front side 618 and back side 619 of the bag. In this embodiment, the pull tab 640 is cut on three sides to define it. The pull tab 640 is cut on the sides closest to the left side 614, top side 611 and bottom side 612. The side of the pull tab 640 closest to the right side 613 is not cut and remains attached to an area of the front side 618 situated within the area defined by a series of holes 641. While not shown in the figures, the rear side 619 has a substantially similar pull tab that is a mirror image of the front side 618.

The series of holes 641 on the front side 618 and the series of holes 642 on the back side 619 of the collection bag are substantially similar to a mirror image of one another. The holes 641 are close enough together and of a large enough diameter to allow a user pulling on pull tab 640 in the direction denoted by arrow 622 to cleanly tear an opening in the front side 618 of the collection bag that would be substantially the same shape as the outline created by the series of holes 641. The series of holes 642 on the back side 619 are situated similarly to the front to allow a user to tear a second opening in the back side 619 of the collection bag 610.

Similar to the fifth embodiment, because the series of holes 641 & 642 and the creation of pull tabs 640 create through openings in the front side 618 and rear side 619 of the collection bag 610, it is preferable to place these features above the expected height of the load to prevent free communication between the load and the user's skin. The series of holes 641 & 642 are preferably small enough to prevent free communication through light or incidental contact between the load on the inside of the bag and the user on the outside of the bag, however, prolonged contact could allow some of the load to escape through the series of openings 641 & 642, making their placement above the height of the expected load a preferential feature.

The height of the series of holes 641 & 642 relative to the bottom of the bag 612 can varied depending on the expected height of the load when placed in the collection bag 610. The shape of the area situated within the series of holes 641 & 642 may also be varied to be longer, shorter, wider or not substantially rectangular in shape to change the characteristics of the bag when placed in a moving fluid. If the shape and location of the series of holes 641 & 642 are changed, the tear tab 640 (and a similar tear tab on the back side 619) would similarly need to be relocated to an area at the perimeter of the series of holes 641 & 642.

Similar to the fifth embodiment, in the sixth embodiment, the front side 618 and back side 619 of the collection bag 610 are substantially similar mirror images of each other to facilitate manufacturing using a pre-formed tube of material.

When using a pre-formed tube of material, the sides 613 & 614 and side gussets of the collection bag would be pre-sealed, only necessitating the bottom end 612 of the bag to be sealed. The tube of material would need to be cut at the top end 611 and bottom end 612 to define the overall shape of the collection bag 610. The tear tabs 640 and series of holes 641 & 642 can be cut from a single direction (i.e. cut from the front side 618), resulting in a front side 618 and back side 619 that are mirror images of one another. If the collection bag 610 were to be constructed from two or more sheets of material that was then sealed on the sides 613 & 614 and bottom 612, the shape of the tear tabs 640 and series of holes 641 & 642 could differ on the front side 618 and back side 619.

Figure 27:
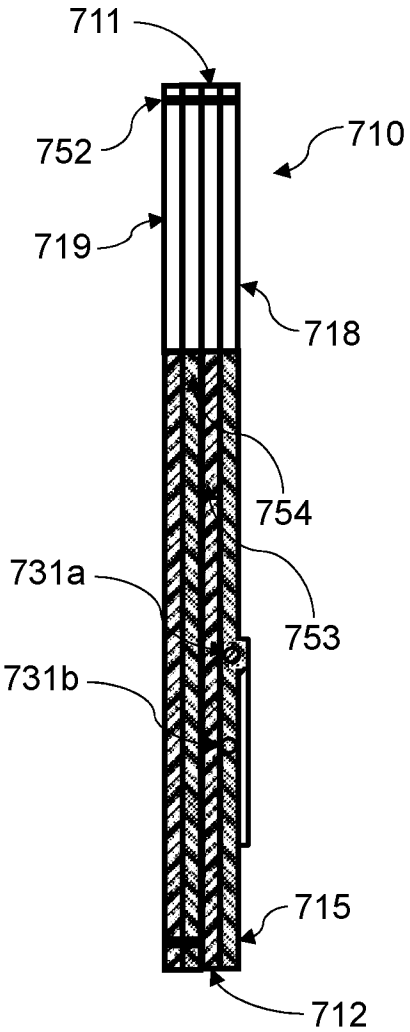
FIG. 27 is a side sectioned view of a seventh embodiment of the invention in a first position.
Figure 26:
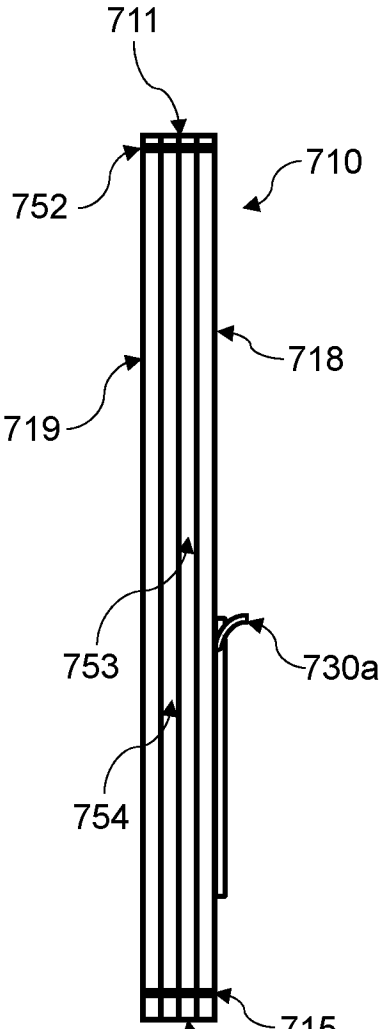
FIG. 26 is a side view of a seventh embodiment of the invention in a first position.
Figure 25:
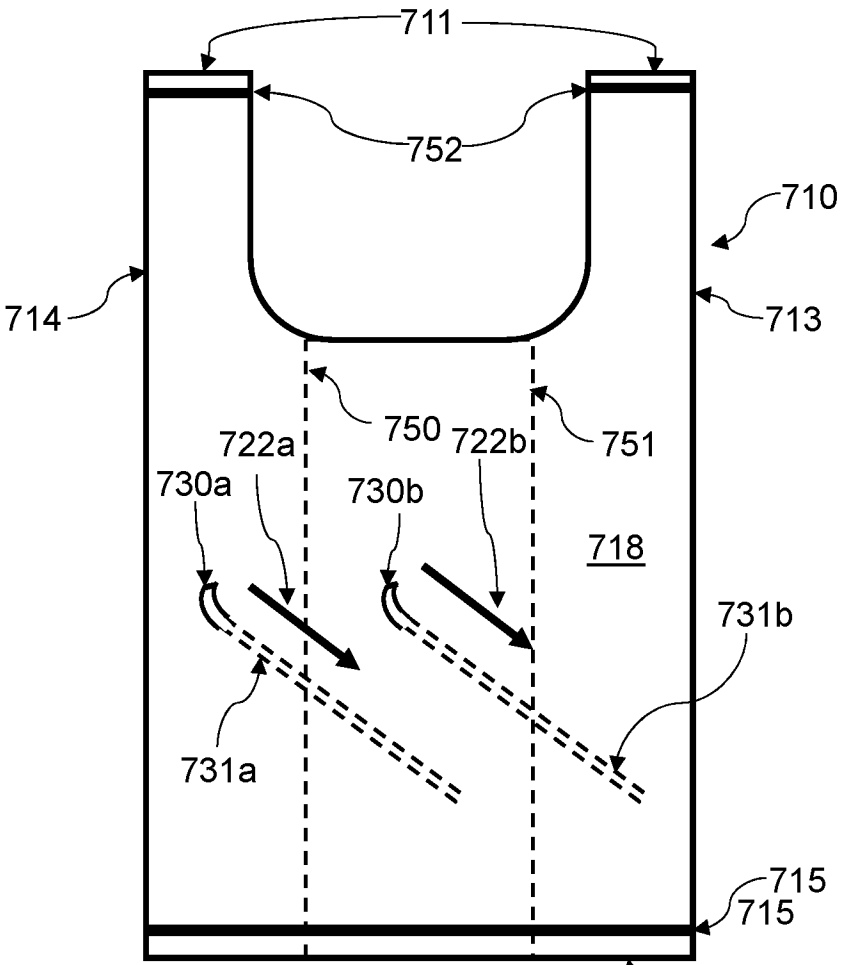
FIG. 25 is a front view of a seventh embodiment of the invention in a first position.

In FIGS. 25-27 is a seventh embodiment of the collection bag 710 in a first position. The rear side 719 of the collection bag 710 in FIGS. 25-27 is substantially similar to the front side 718, but without the tear tabs 730*a* & 730*b* or tear strips 731*a* & 731*b*, therefore only a front, side and side sectioned view are shown. The rear side 719 may optionally include one or more tear tabs, tear strips or other means for creating an opening. The collection bag 710 has a sealed right side 713 and left side 714 with gusseted panels. The gusseted panels are hidden in the front view, but their width is marked with dashed lines 750 & 751. The gusseted panels have a front panel 753 and back panel 754 that fold between front side 718 and back side 719. The bottom end 712 of the collection bag 710 is sealed. The top end 711 of the collection bag 710 is also sealed in the handle areas 752 to form two handles when the collection bag is opened. The collection bag 710 can use a heat seal 715 and 752 to seal portions of the collection bag 710, but it appreciated that there are other appropriate methods of sealing the bag as noted previously. The top end 711 of the collection bag 710 is open between the heat sealed areas 752 and provides the opening for a user to insert the load.

The collection bag 710 has two tear tags 730*a* & 730*b* and two hidden tear strips 731*a* & 731*b* to allow a user to create two openings in the front side 718 of the bag. The tear tags 730*a* & 730*b* and hidden tear strips 731*a* & 731*b* may be constructed of a single continuous material or multiple materials. The tear tags 730*a* & 730*b* and hidden tear strips 731*a* & 731*b* may be constructed of string, plastic, metal, PVA or any other appropriate material that is flexible enough for a user to pull in the direction denoted by arrows 722*a* & 722*b*, respectively, and strong enough to create an opening in the front side 718 of the collection bag 710. In FIG. 25, the hidden tear strips 730*a* & 730*b* are shown as dotted lines because it is mounted within or behind the front side 718 in this embodiment. The hidden tear strips 731*a* & 731*b* may alternatively be adhered to the front of the bag to accomplish the same ends.

The height of the hidden tear strips 731*a* & 731*b* relative to the bottom of the bag 712 can varied to place the resultant opening above or adjacent to the load when placed in the collection bag 710. The shape of the hidden tear strips 731*a* & 731*b* may also be varied to be longer, shorter, wider or not substantially straight to change the characteristics of the bag when placed in a moving fluid. If the shape and location of the hidden tear strips 731*a* & 731*b* are changed, the tear tags 730*a* & 730*b* would similarly need to be relocated to the new beginning of the hidden tear strips 731*a* & 731*b*.

The seventh embodiment, as shown, only has tear tags 730*a* & 730*b* and hidden tear strips 731*a* & 731*b* fixed to the front side 718 of the collection bag 710, however, they may optionally be added to the back side 719 as well. The number of tear tags and tear strips may be added or subtracted to change the characteristics of the collection bag 710. While the tear strips 731*a* & 731*b* are shown as further from the bottom end 712 towards the left side 714 of the bag in comparison to the right side 713 of the bag, their orientation may be changed within the inventive concept expressed herein.

The embodiments of the collection bag disclosed herein can be used in a method of disposing bodily waste and pet fecal matter in a toilet that is resistant to plumbing system clogs. The collection bags prevent the formation a large mass comprised of the collection bag, the load and air situated inside the collection bag. To prevent the plumbing clogs, the present invention allows a user to place the collection bag and load in a toilet in a state that is less likely to require intervention by a plumber when disposed through a residential plumbing system. By creating opening(s) in the bag, the user is both eliminating any air from being trapped inside the bag and immediately allowing water to flow against the load to quickly break it up as it flows through the plumbing system. The opening(s) also allow the water to quickly act on both sides of the bag material, increasing its rate of dissolving.

Figure 28:
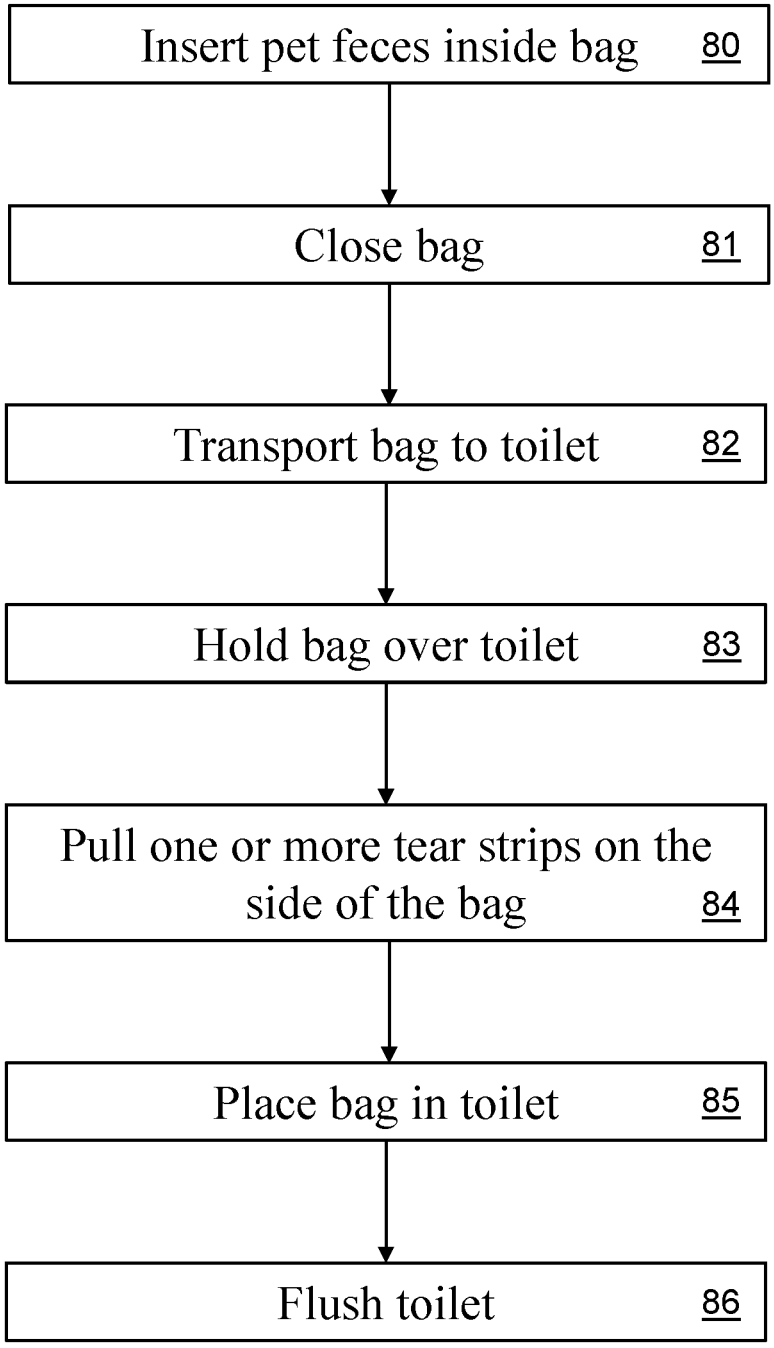
FIG. 28 is a flow chart of a first method of using the present invention.

The method of the present invention is depicted in a flow chart in FIG. 28. The first step includes a user inserting pet feces into the collection bag of the present invention 80. There are many available methods for a user to insert the load into the collection bag. In one method, the user can place the feces into the collection bag through the opening at the top end of the bag. In another method, the user may also turn the collection bag inside out to grasp a load and then return the bag to its original state, leaving the load inside the bag. In another method, some embodiments of the present invention allow a user to insert their hand inside of the bag to grasp a load on the outside of the bag and then turn the bag inside out, leaving the load inside the bag. Other methods of inserting the load into the collection bag exist and may be performed by the user, depending on preference.

The second step is to close the bag 81. This step is optional and can be accomplished by tying the top end of the collection bag into a knot, using an external tie, using a clip, etc. A user may use multiple types of knots, including but not limited to, an overhand knot, a half knot or a square knot using the upper bag material. Other methods of closing the top end of the bag exist and may be performed by the user, depending on preference. Once the load is inside the collection bag and the bag is optionally closed at its top, the load is ready to be transported to a toilet 82.

Once near a toilet, the user then holds the collection bag near or over the toilet 83 to prepare the collection bag and load for insertion into the toilet bowl. The user pulls on one or more areas on the front, back top or side of the collection bag to create opening(s) 84. After one or more openings is created in the front, back top or sides of the collection bag containing the load, the user then places the collection bag and load into the toilet bowl 85. At this point, water is able to enter the collection bag through the opening(s), softening the load and allowing the water to act on both the inside and outside of the collection bag to dissolve it. The user can then flush the toilet 86, causing the collection bag and load to exit the residence through the plumbing system.

Figure 31:
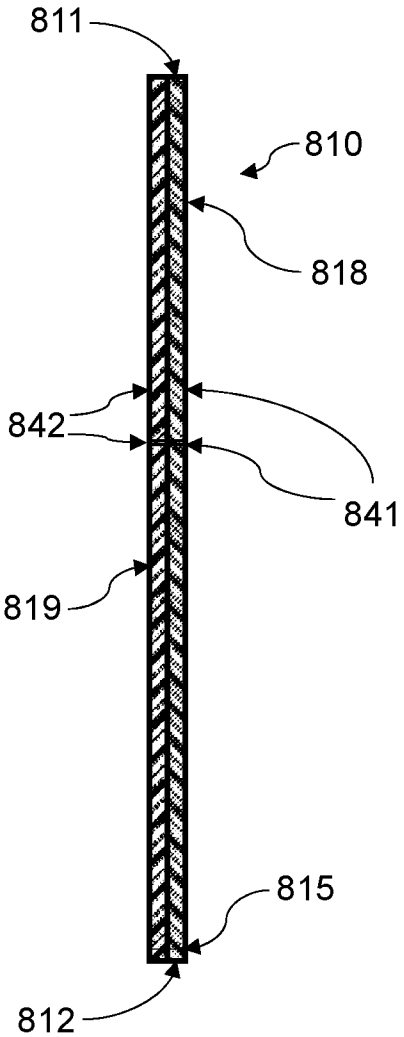
FIG. 31 is a side sectioned view of an eighth embodiment of the invention in a first position.
Figure 30:
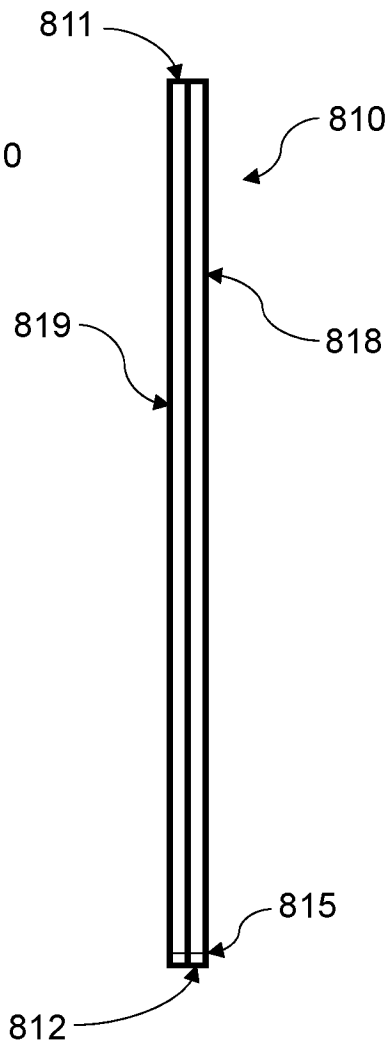
FIG. 30 is a side view of an eighth embodiment of the invention in a first position.
Figure 29:
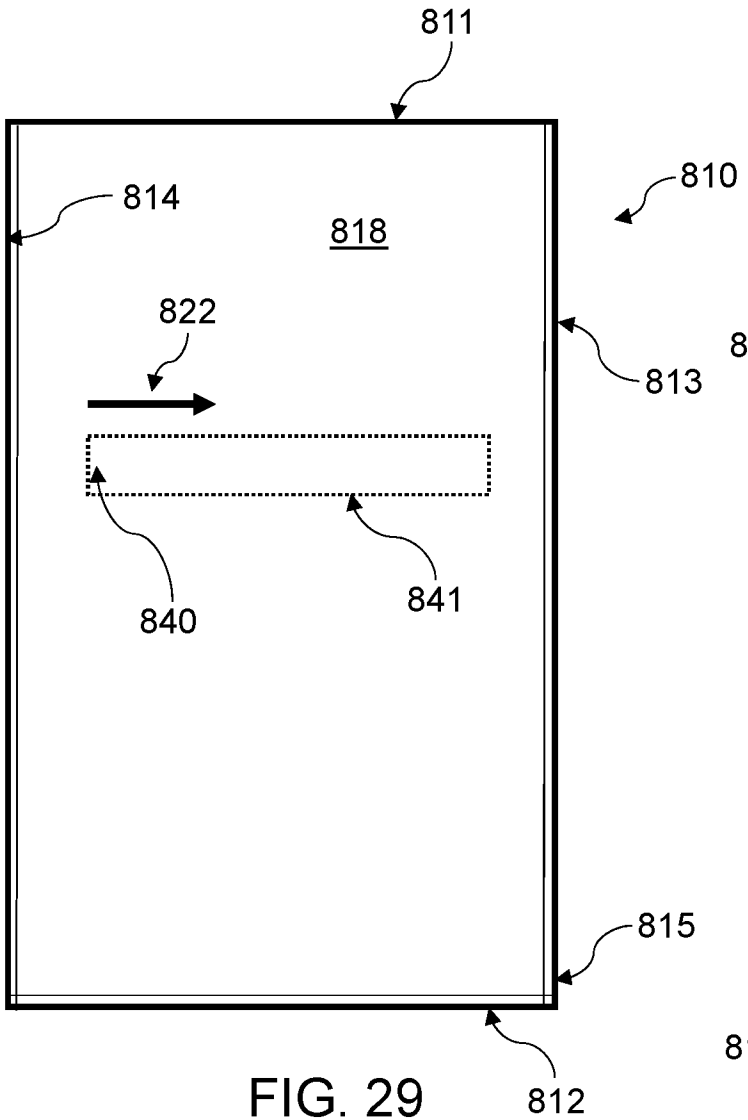
FIG. 29 is a front view of an eighth embodiment of the invention in a first position.

In FIGS. 29-31 is an eighth embodiment of the collection bag 810 in a first position. The rear side 819 of the collection bag 810 in FIGS. 29-31 is substantially similar to the front side 818, therefore only a front, side and side sectioned view are shown. The rear side 819 may optionally include one or more tear tabs, tear strips or other means for creating an opening. The collection bag 810 has a sealed right side 813 and left side 814. The bottom end 812 of the collection bag 810 is sealed. The top end 811 of the collection bag 810 is open to allow the insertion of the load. The collection bag 810 can use a heat seal 815 to seal portions of the collection bag 810, but it appreciated that there are other appropriate methods of sealing the bag as noted previously.

The collection bag 810 has a perforated tear area 840 on the front side 818 defined by a series of perforations 841. The rear side 819 has a series of perforations 842 that define a similar perforated tear area. The collection bag 810 may be sealed on its open end 811 after the insertion of a load by tying the open end 811 closed, among other noted methods. Once ready to place in a toilet, a user may remove the perforated tear area 840 by grasping it and pulling in the direction denoted by arrow 822. A user may also remove the perforated tear area 840 or puncture the area by thrusting a finger through the perforated tear area 840, grasping and pulling in a direction opposite of the direction denoted by arrow 822 or another variation of the described methods.

The height of the perforated tear area 840 relative to the bottom of the bag 812 can varied to place the resultant opening above or adjacent to the load when placed in the collection bag 810. The shape of the perforated tear area 840 may also be varied to be longer, shorter, wider or not substantially straight to change the characteristics of the bag when placed in a moving fluid.

Figure 34:
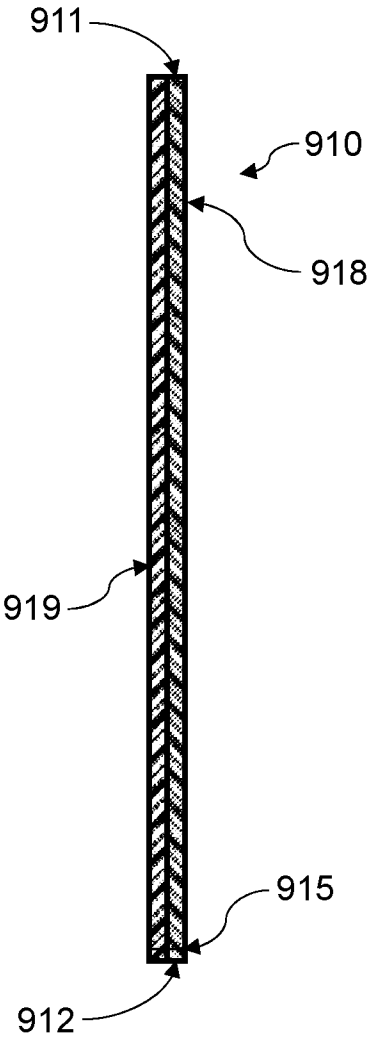
FIG. 34 is a side sectioned view of a ninth embodiment of the invention in a first position.
Figure 33:
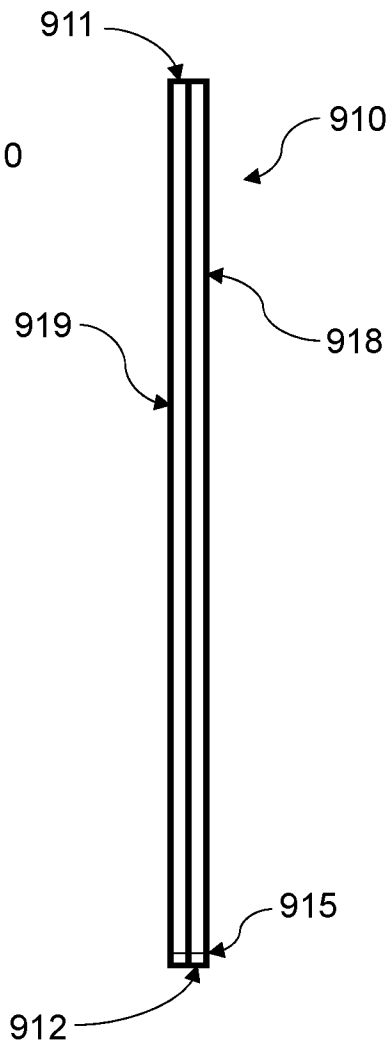
FIG. 33 is a side view of a ninth embodiment of the invention in a first position.
Figure 32:
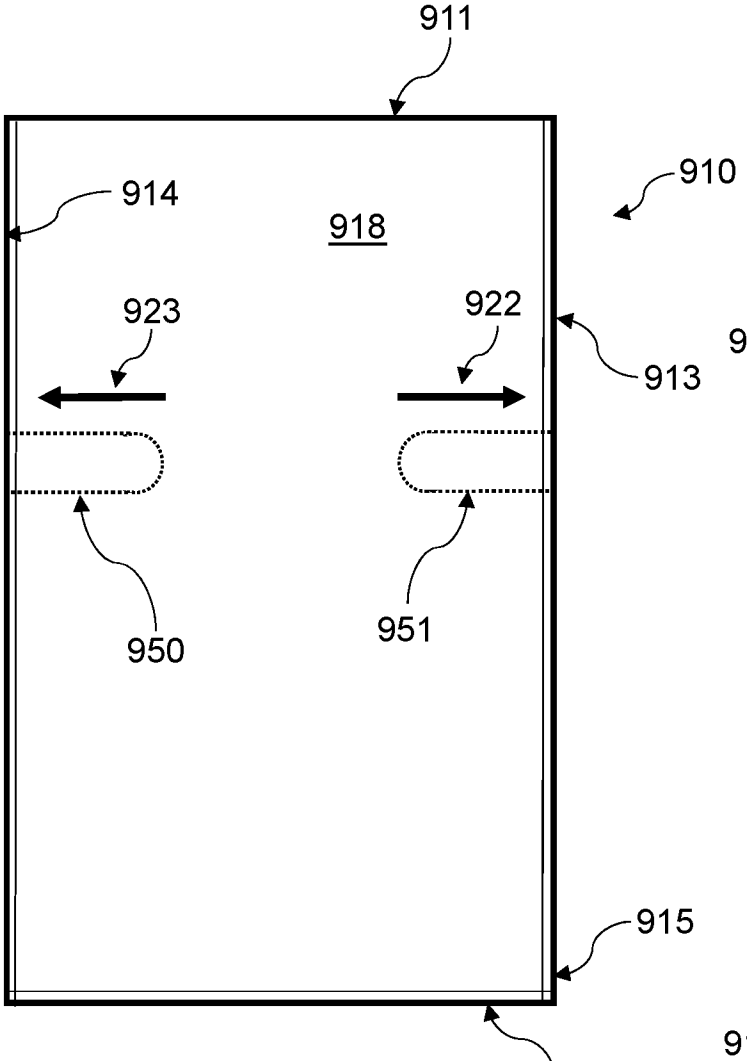
FIG. 32 is a front view of a ninth embodiment of the invention in a first position.
Figure 35:
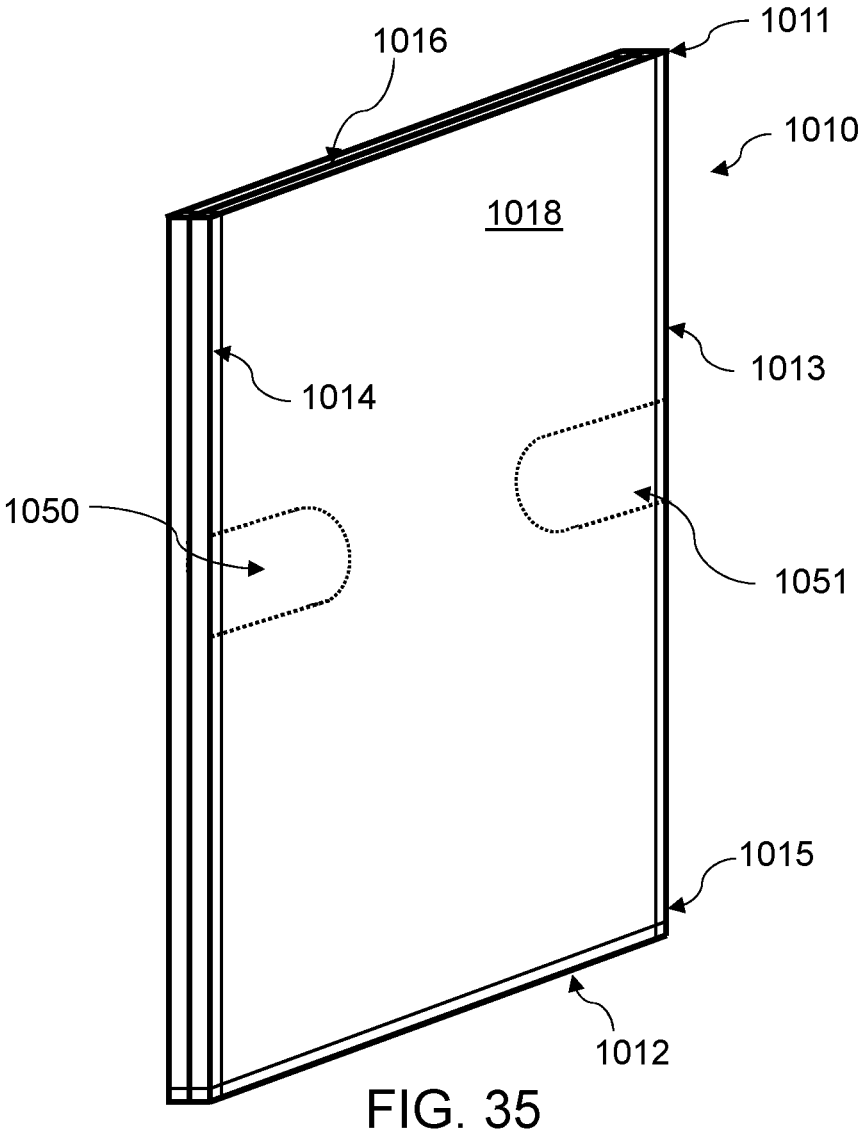
FIG. 35 is a perspective view of a tenth embodiment of the invention in a first position.
Figures 36, 37, 38:
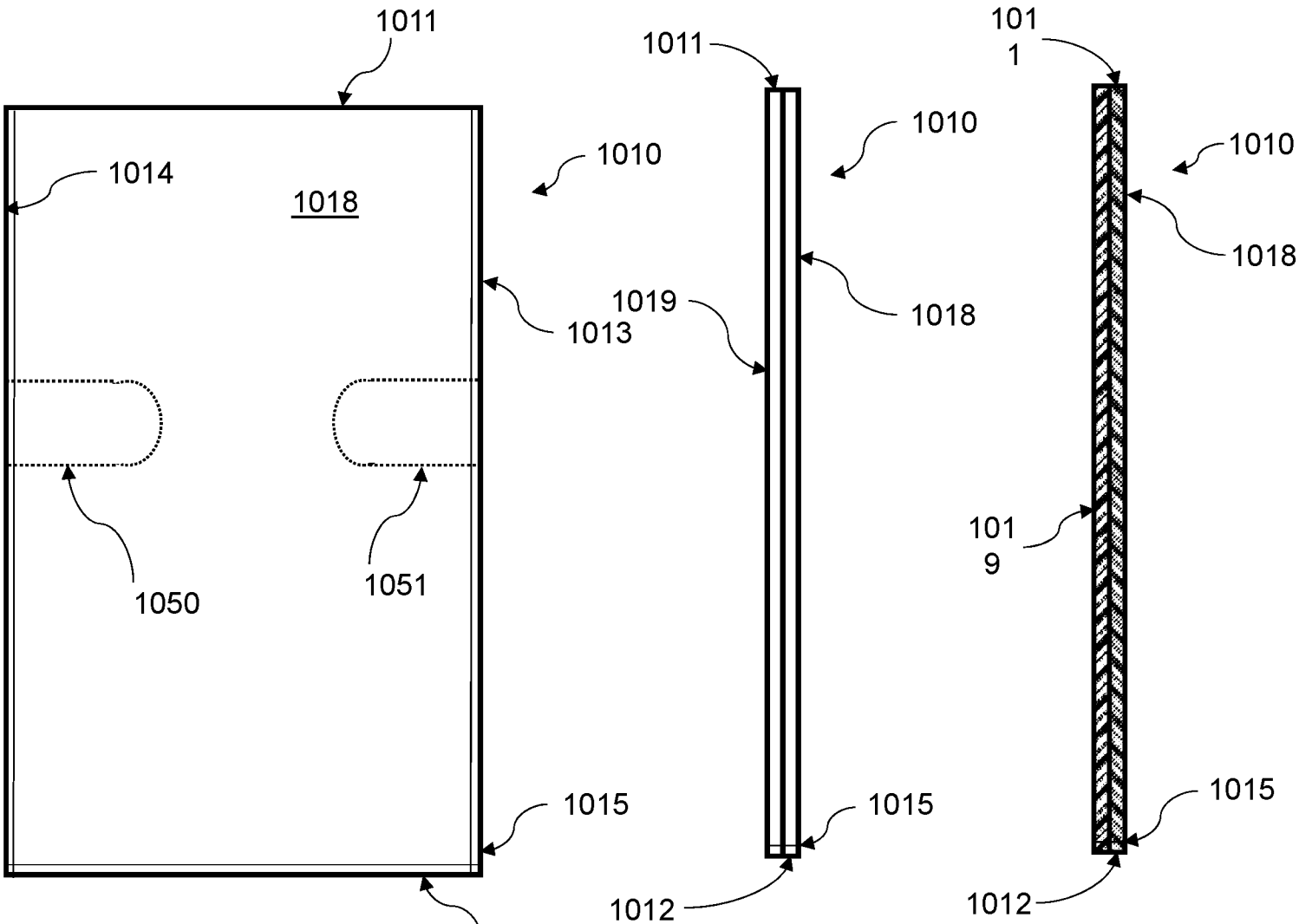
FIG. 36 is a front view of a tenth embodiment of the invention in a first position.
FIG. 37 is a side view of a tenth embodiment of the invention in a first position.
FIG. 38 is a side sectioned view of a tenth embodiment of the invention in a first position.

In FIGS. 32-34 is a ninth embodiment of the collection bag 910 in a first position. The rear side 919 of the collection bag 910 in FIGS. 32-34 is substantially similar to the front side 918, therefore only a front, side and side sectioned view are shown. The collection bag 910 has a sealed right side 913 and left side 914. The bottom end 912 of the collection bag 910 is sealed. The top end 911 of the collection bag 810 is open to allow the insertion of the load. The collection bag 910 can use a heat seal 915 to seal portions of the collection bag 910, but it appreciated that there are other appropriate methods of sealing the bag as noted previously.

The collection bag 910 has a first perforated tear area 950 and a second perforated tear area 951 on the front side 918 defined by a series of perforations. The perforations extend through the bag to the rear side 919 to define similar perforated tear areas. The collection bag 910 may be sealed on its open end 911 after the insertion of a load by tying the open end 911 together, among other methods noted. Once ready to place in a toilet, a user may remove the perforated tear areas 950 & 951 by grasping them and pulling in the direction denoted by arrows 923 & 922 respectively. A user may also remove the perforated tear areas 950 & 951 or puncture the area by thrusting a finger through the perforated tear areas 950 & 951, grasping each perforated tear area 950 & 951 with a finger contacting the front side 918 and rear side 919 and pulling in a direction denoted by arrows 923 & 922 respectively or another variation of the described methods.

The height of the perforated tear areas 950 & 951 relative to the bottom of the bag 912 can be varied to place the resultant opening above or adjacent to the load when placed in the collection bag 910. The shape of the perforated tear areas 950 & 951 may also be varied to be longer, shorter or wider, either together or singularly, to change the characteristics of the bag when placed in a moving fluid.

In FIGS. 35-38 is a tenth embodiment of the collection bag 1010 in a first position. The rear side 1019 of the collection bag 1010 in FIGS. 35-38 is substantially similar to the front side 1018, therefore only a front, side and side sectioned view are shown. The collection bag 1010 has a sealed right side 1013 and left side 1014. The bottom end 1012 of the collection bag 1010 is sealed. At the top end 1011 of the collection bag 1010 is opening 1016 to allow the insertion of the load. The collection bag 1010 can use a heat seal 1015 to seal portions of the collection bag 1010, but it appreciated that there are other appropriate methods of sealing the bag as noted previously.

The collection bag 1010 has a first perforated tear area 1050 and a second perforated tear area 1051 on the front side 1018 defined by a series of perforations. The perforations extend through the bag to the rear side 1019 to define similar perforated tear areas. The collection bag 1010 may be sealed on its open end 1011 after the insertion of a load by tying the open end 1011 together, among other methods noted. Once ready to place in a toilet, a user may remove the perforated tear areas 1050 & 1051 by grasping them and pulling laterally in a direction away from the collection bag 1010. A user may also remove the perforated tear areas 1050 & 1051 or puncture the area by thrusting a finger through the perforated tear areas 1050 & 1051, grasping each perforated tear area 1050 & 1051 with a finger contacting the front side 1018 and rear side 1019 and pulling in a lateral direction away from the collection bag 1010 or another variation of the described methods.

The height of the perforated tear areas 1050 & 1051 relative to the bottom of the bag 1012 can be varied to place the resultant opening above or adjacent to the load when placed in the collection bag 1010. The shape of the perforated tear areas 1050 & 1051 may also be varied to be longer, shorter or wider, either together or singularly, to change the characteristics of the bag when placed in a moving fluid.

In some embodiments of the collection bag 1010, the height of the perforated tear areas 1050 & 1051 is substantially the same and between and including 5.0 to 50.0 percent of the height of the collection bag 1010. In other embodiments, the height of the perforated tear areas 1050 & 1051 is substantially the same and between and including 5.0 to 30.0 percent of the height of the collection bag 1010. In other embodiments, the height of the perforated tear areas 1050 & 1051 is substantially the same and between and including 8.0 to 12.0 percent of the height of the collection bag 1010.

In some embodiments of the collection bag 1010, the width of each perforated tear area 1050 & 1051 is substantially the same and between and including 5.0 to 50.0 percent of the width of the collection bag 1010. In other embodiments, the width of each perforated tear area 1050 & 1051 is substantially the same and between and including 10.0 to 30.0 percent of the width of the collection bag 1010. In other embodiments, the width of each perforated tear area 1050 & 1051 is substantially the same and between and including 15.0 to 30.0 percent of the width of the collection bag 1010.

For most pet fecal matter applications, it is preferable for the horizontal center of the perforated areas 1050 & 1051 to be between a distance of and including 35.0 to 85.0 percent of the height of the collection bag 1010 from the bottom edge. For most pet fecal matter applications, it is more preferable for the horizontal center of the perforated areas 1050 & 1051 to be between a distance of and including 50.0 to 75.0 percent of the height of the collection bag 1010 from the bottom edge. For most pet fecal matter applications, it is most preferable for the horizontal center of the perforated areas 1050 & 1051 to be between a distance of and including 60.0 to 70.0 percent of the height of the collection bag 1010 from the bottom edge.

The collection bag 1010 is preferably configured so that the height of each perforated area 1050 & 1051 is substantially the same and between and including 5.0 to 30.0 percent of the height of the collection bag 1010, so that the width of each perforated area 1050 & 1051 is substantially the same and between and including 10.0 to 30.0 percent of the width of the collection bag and so that the horizontal center of the perforated areas 1050 & 1051 to be between a distance of and including 35.0 to 85.0 percent of the height of the collection bag 1010 from the bottom edge. The collection bag 1010 is more preferably configured so that the height of each perforated area 1050 & 1051 is substantially the same and between and including 8.0 to 12.0 percent of the height of the collection bag 1010, so that the width of each perforated area 1050 & 1051 is substantially the same and between and including 15.0 to 30.0 percent of the width of the collection bag and so that the horizontal center of the perforated areas 1050 & 1051 to be between a distance of and including 50.0 to 75.0 percent of the height of the collection bag 1010 from the bottom edge. The collection bag 1010 is most preferably configured so that the height of each perforated area 1050 & 1051 is substantially the same and between and including 8.0 to 12.0 percent of the height of the collection bag 1010, so that the width of each perforated area 1050 & 1051 is substantially the same and between and including 25.0 to 30.0 percent of the width of the collection bag and so that the horizontal center of the perforated areas 1050 & 1051 to be between a distance of and including 60.0 to 70.0 percent of the height of the collection bag 1010 from the bottom edge. The term "substantially similar" as used herein refers to a value that is within plus or minus 10.0 percent of one another.

Figures 39, 40, 41:
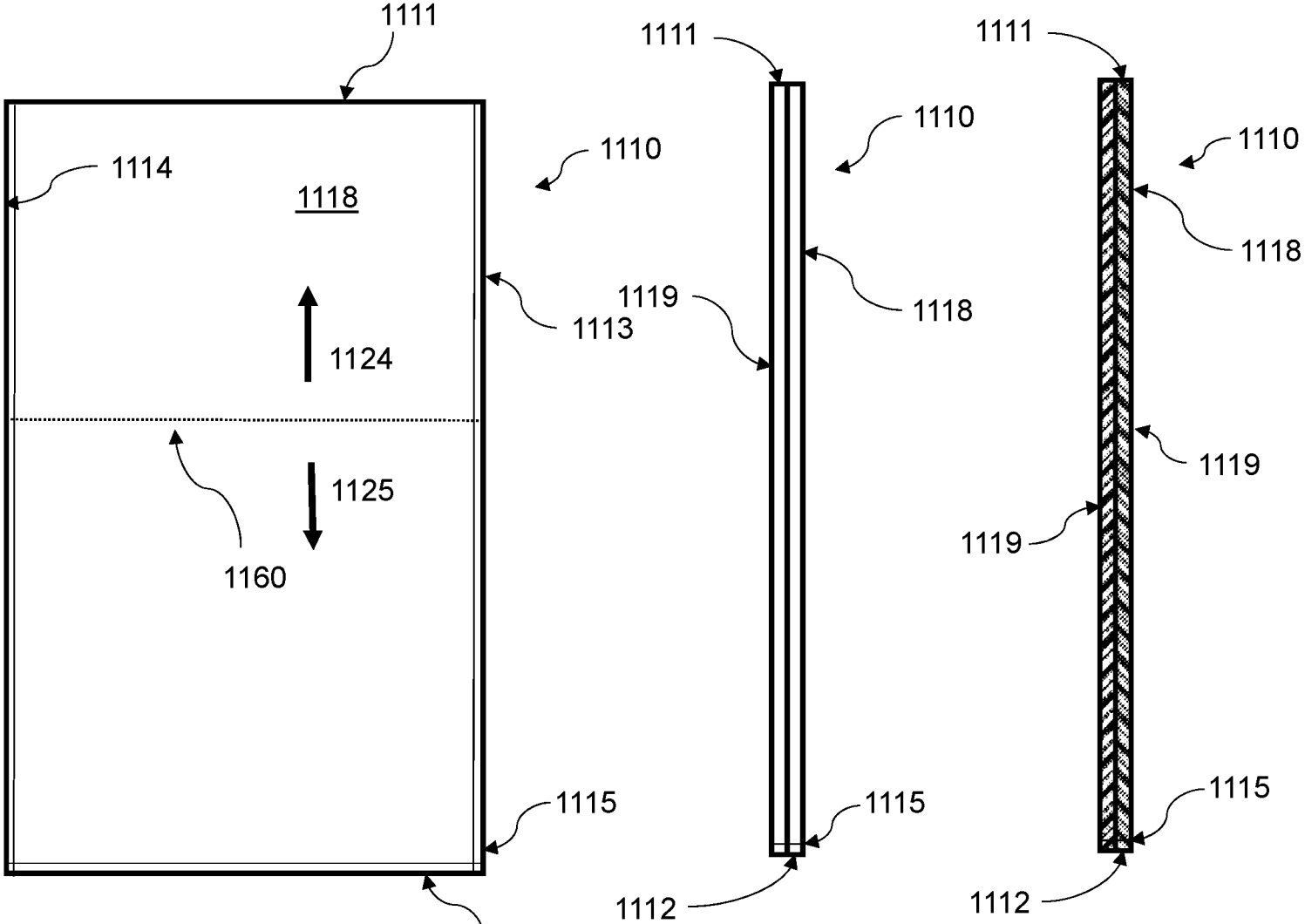
FIG. 39 is a front view of an eleventh embodiment of the invention in a first position.
FIG. 40 is a side view of an eleventh embodiment of the invention in a first position.
FIG. 41 is a side sectioned view of an eleventh embodiment of the invention in a first position.

In FIGS. 39-41 is an eleventh embodiment of the collection bag 1110 in a first position. The rear side 1119 of the collection bag 1110 in FIGS. 39-41 is substantially similar to the front side 1118, therefore only a front, side and side sectioned view are shown. The collection bag 1110 has a sealed right side 1113 and left side 1114. The bottom end 1112 of the collection bag 1110 is sealed. At the top end 1111 of the collection bag 1110 is an opening to allow the insertion of the load. The collection bag 1110 can use a heat seal 1115 to seal portions of the collection bag 1110, but it appreciated that there are other appropriate methods of sealing the bag as noted previously.

The collection bag 1110 has a perforated line 1160 defined by a series of perforations. The perforations extend through the bag to the rear side 1119 to define a similar perforated line. The collection bag 1110 may be sealed on its open end 1111 after the insertion of a load by tying the open end 1111 together, among other methods noted. Once ready to place in a toilet, a user may create an opening along the perforated line 1160 by grasping the top end of the bag 1111 with one hand, grasping the bottom end of the bag 1112 with another hand, pulling the top end of the bag 1111 in the direction denoted by arrow 1124 and pulling the bottom end of the bag 1112 in the direction denoted by arrow 1125. By pulling the top end of the bag 1111 and bottom end of the bag 1112 in opposite directions, the collection bag 1110 tends to tear along the perforated line 1160, creating an opening.

The height of the perforated line 1160 relative to the bottom of the bag 1112 can be varied to place the resultant opening above or adjacent to the load when placed in the collection bag 1110. The shape of the perforated line 1160 may also be varied to not be substantially straight to change the characteristics of the bag when placed in a moving fluid. In some embodiments, the perforated line 1160 is horizontal relative to the bottom of the bag 1112 and located at a height on the upper 60 percent of the bag, meaning the height of the perforated line 1160 is at least 40 percent the height of the bag. In some embodiments, the perforated line 1160 is horizontal relative to the bottom of the bag 1112 and located at a height on the upper 50 percent to 75 percent of the bag. In some embodiments, the perforated line 1160 is horizontal relative to the bottom of the bag 1112 and located at a height on the upper 55 percent to 65 percent of the bag.

In some embodiments, a vertical tear strip or perforated area can be used on the front panel, rear panel or in the vicinity of the lateral seals. A vertical tear strip or perforated area can be beneficial to prevent interference with the strip or area when the bag is tied at its top. In some embodiments, the vertical tear strip(s) or perforated area(s) are designed to be pulled in the upward direction to prevent the beginning of the strip or area from being caught in the tied top of the bag. In some embodiments, the vertical tear strip(s) or perforated area(s) are positioned so that they are higher from the bottom of the bag than the height of the expected load.

What has been described is a collection bag that reduces plumbing system clogs and method of disposing of bodily waste and pet feces in a toilet that reduces clogs. While this disclosure shows the invention as a collection bag, all or part of the invention is capable of being used in other applications. In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. A pet waste collection bag, comprising:

a front panel, rear panel, right side, left side, a top end and a bottom end;

where said front panel and rear panel are sealed along the right side, left side and bottom end of the bag; and wherein the front panel has a first selectively covered opening; and wherein the first selectively covered opening is discrete from the top end;

wherein said first selectively covered opening further comprises an area defined by a line of perforations along its perimeter;

wherein said first selectively covered opening is located on the right side of the bag;

wherein a second selectively covered opening is located on the left side of the bag, where said second selectively covered opening further comprises an area defined by a line of perforations along its perimeter; and wherein said line of perforations defining said selectively covered openings are comprised of a series of punctures that extend through the front panel and rear panel.

2. The pet waste collection bag of claim 1 wherein said first selectively covered opening further comprises a first opening on said front panel removably covered by a first removable panel.

3. The pet waste collection bag of claim 2 further comprising a second selectively covered opening on said rear panel, where said second selectively covered opening further comprises a second opening on said rear panel removably covered by a second removable panel.

4. The pet waste collection bag of claim 3 wherein said first and second opening are each further comprised of a plurality of quadrilateral shaped openings.

5. The pet waste collection bag of claim 1 wherein said collection bag is further comprised of polyvinyl alcohol (PVA).

6. The pet waste collection bag of claim 1 wherein said collection bag is further comprised of polyvinyl alcohol (PVA).

* * * * *